US008757408B2

(12) United States Patent
Joubert et al.

(10) Patent No.: US 8,757,408 B2
(45) Date of Patent: Jun. 24, 2014

(54) BOTTLE CLOSURE WITH CHAMBER FOR HOLDING AN ITEM

(76) Inventors: Brad T. Joubert, Kankakee, IL (US); Jonathan P. Mitts, Bourbonnais, IL (US)

( * ) Notice: Subject to any disclaimer, the term of this patent is extended or adjusted under 35 U.S.C. 154(b) by 1048 days.

(21) Appl. No.: 12/342,990

(22) Filed: Dec. 23, 2008

(65) Prior Publication Data

US 2009/0114615 A1 May 7, 2009

Related U.S. Application Data

(63) Continuation-in-part of application No. 11/779,922, filed on Jul. 19, 2007, now abandoned.

(51) Int. Cl.
*B65D 1/04* (2006.01)
*B65D 39/04* (2006.01)
*B65D 23/12* (2006.01)

(52) U.S. Cl.
USPC ..... 215/227; 215/6; 215/228; 220/521

(58) Field of Classification Search
USPC ..... 215/227, 6, 228, DIG. 8; 220/521, 522, 220/277, 278; 206/219, 222
See application file for complete search history.

(56) References Cited

U.S. PATENT DOCUMENTS 468,226 A 2/1892 Painter
765,439 A 7/1904 Pike
814,503 A 3/1906 Andersen et al.
1,283,347 A * 10/1918 Spelling ..... 215/40
1,584,903 A * 5/1926 Supplee ..... 426/124
1,878,541 A 9/1932 Reinhold
2,048,219 A * 5/1936 Putter ..... 215/6
2,129,406 A 9/1938 Cole
2,243,629 A 5/1941 Hodgson
2,317,882 A * 4/1943 Boesel ..... 96/148
2,321,998 A 6/1943 Crouch et al.
2,385,648 A 9/1945 Prager
2,739,751 A 3/1956 Bailey
2,758,932 A * 8/1956 Scott ..... 426/8
2,852,326 A * 9/1958 Westlake, Jr. ..... 312/31.1
2,863,582 A 12/1958 Ownes
3,035,730 A * 5/1962 Walker et al. ..... 215/228
3,067,867 A 12/1962 Bonham et al.
3,220,555 A * 11/1965 Silha ..... 210/282
3,233,770 A 2/1966 Waters
3,254,784 A * 6/1966 Lancesseur ..... 96/148
3,257,021 A 6/1966 Brockett
3,557,987 A 1/1971 Singer, Jr.
3,559,834 A 2/1971 Taylor
3,581,690 A 6/1971 Zapata
3,840,136 A 10/1974 Lanfranconi et al.
3,941,269 A 3/1976 Flax
4,111,323 A 9/1978 Ichinose et al.
4,132,308 A 1/1979 Goncalves
4,157,143 A 6/1979 Doi
4,165,009 A 8/1979 Murayama (Continued)

*Primary Examiner* — Anthony Stashick
*Assistant Examiner* — Ned A Walker
(74) *Attorney, Agent, or Firm* — Miller, Matthias & Hull LLP

(57) ABSTRACT

A closure for beverage containers, such as wine bottles, champagne bottles, beer bottles, liquor bottles, soda bottles, and the like, may include a head portion defining a chamber for housing an item and an opening for providing access to the item. The closure may further include a stub portion for sealing a mouth of the bottle and a cap that releasably engages the opening.

13 Claims, 18 Drawing Sheets

(56) References Cited

U.S. PATENT DOCUMENTS

| | | | | | |
|---|---|---|---|---|---|
| 4,287,995 | A | * | 9/1981 | Moriya | 215/228 |
| 4,350,508 | A | * | 9/1982 | Santoro et al. | 96/117.5 |
| 4,372,457 | A | | 2/1983 | Kunimoto et al. | |
| 4,421,235 | A | * | 12/1983 | Moriya | 206/524.2 |
| 4,444,329 | A | | 4/1984 | Vollers | |
| 4,621,743 | A | * | 11/1986 | DiRegolo et al. | 215/308 |
| 4,720,351 | A | | 1/1988 | Flynn et al. | |
| 4,756,436 | A | * | 7/1988 | Morita et al. | 215/228 |
| 4,812,317 | A | | 3/1989 | Taylor | |
| 4,838,442 | A | * | 6/1989 | Merry | 215/228 |
| 5,019,212 | A | * | 5/1991 | Morita et al. | 162/157.3 |
| 5,025,941 | A | | 6/1991 | Petit | |
| 5,056,681 | A | | 10/1991 | Howes | |
| 5,114,011 | A | * | 5/1992 | Robbins, III | 206/499 |
| 5,117,995 | A | * | 6/1992 | Kau | 215/228 |
| 5,261,547 | A | | 11/1993 | Finke | |
| 5,392,939 | A | | 2/1995 | Hidding et al. | |
| 5,447,246 | A | | 9/1995 | Finke | |
| 5,447,247 | A | | 9/1995 | Derkesen | |
| 5,449,080 | A | | 9/1995 | Finke | |
| 5,524,788 | A | | 6/1996 | Plester | |
| 5,654,022 | A | | 8/1997 | Sayre | |
| 5,806,707 | A | | 9/1998 | Boehm et al. | |
| 5,807,597 | A | | 9/1998 | Barnes et al. | |
| 5,811,060 | A | * | 9/1998 | Laguna Valderrama | 422/556 |
| 5,868,264 | A | | 2/1999 | Fulford et al. | |
| 5,896,686 | A | | 4/1999 | Howes | |
| 5,924,739 | A | | 7/1999 | Garbutt | |
| 5,934,494 | A | * | 8/1999 | Takahashi et al. | 215/347 |
| 6,005,204 | A | | 12/1999 | Choi et al. | |
| 6,023,865 | A | | 2/2000 | Preuss | |
| 6,032,820 | A | | 3/2000 | Ladina et al. | |
| 6,036,017 | A | | 3/2000 | Bayliss, IV | |
| 6,089,180 | A | | 7/2000 | Nicols, Jr. | |
| 6,168,036 | B1 | * | 1/2001 | Teng | 215/296 |
| 6,274,209 | B1 | * | 8/2001 | Pagidas et al. | 428/35.7 |
| 6,335,691 | B1 | | 1/2002 | Bird | |
| 6,386,367 | B1 | | 5/2002 | Bayless, IV | |
| 6,536,618 | B1 | * | 3/2003 | Hwang et al. | 215/358 |
| 6,681,958 | B2 | | 1/2004 | Sorenson et al. | |
| 6,719,160 | B2 | * | 4/2004 | Sen-Yih | 215/361 |
| 6,740,374 | B2 | | 5/2004 | Carballido | |
| 6,769,560 | B1 | * | 8/2004 | Lin | 215/361 |
| 7,011,222 | B2 | * | 3/2006 | DeJonge | 215/386 |
| 7,175,037 | B2 | | 2/2007 | Deir | |
| 7,185,827 | B2 | * | 3/2007 | Quintard et al. | 239/55 |
| 7,210,575 | B2 | * | 5/2007 | Oswald | 206/219 |
| 7,210,592 | B1 | | 5/2007 | Dautreppe et al. | |
| 7,290,361 | B2 | | 11/2007 | Liao | |
| 7,614,513 | B2 | * | 11/2009 | Anderson | 215/10 |
| 7,632,342 | B2 | * | 12/2009 | Nakanoya et al. | 96/134 |
| 7,900,787 | B2 | * | 3/2011 | Oh et al. | 215/6 |
| 2006/0000921 | A1 | * | 1/2006 | Quintard et al. | 239/44 |
| 2006/0150579 | A1 | | 7/2006 | Macchi | |
| 2007/0026112 | A1 | | 2/2007 | Zimmerman et al. | |
| 2007/0158297 | A1 | | 7/2007 | Querbach | |
| 2009/0020535 | A1 | | 1/2009 | Joubert et al. | |

* cited by examiner

Fig. 20
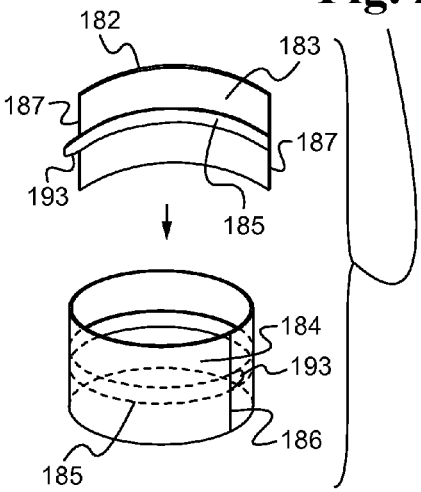
Fig. 21
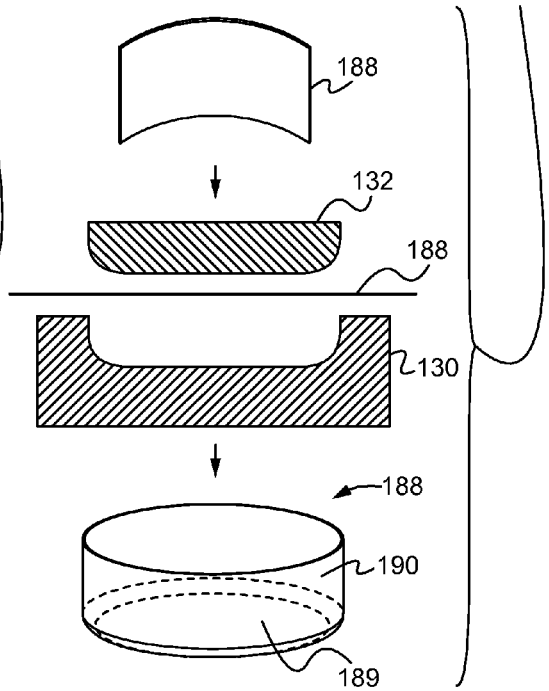
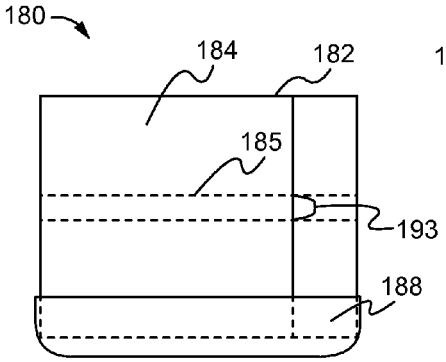
Fig. 22
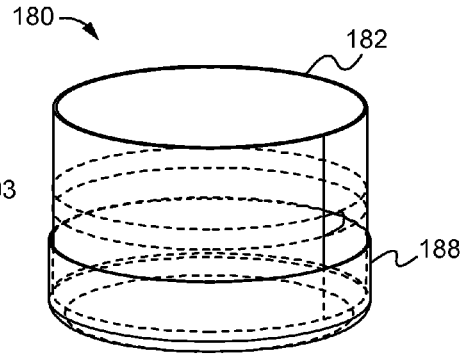
Fig. 23

BOTTLE CLOSURE WITH CHAMBER FOR HOLDING AN ITEM

CROSS REFERENCE

This patent application is a continuation-in-part of U.S. patent application Ser. No. 11/779,922 filed on Jul. 19, 2007, which is incorporated herein by reference in its entirety.

BACKGROUND OF THE INVENTION

This invention relates generally to capsules for containers, and more particularly to capsules for housing items with beverage containers, such as wine bottles, champagne bottles, beer bottles, liquor bottles, soda bottles, and the like.

SUMMARY OF THE INVENTION

The present invention is directed to a capsule for a bottle, which may include a substantially tubular, conformable skirt and a chamber for housing an item. The skirt may include at least one vent hole through the skirt to permit gas to pass through the skirt. The chamber may be positioned at least partially inside and releasably secured to at least a portion of the skirt. The chamber may also comprise at least one standoff extending from the housing for mounting the chamber on a top of the bottle, wherein the at least one standoff may include at least one rim guide for centering the chamber on the bottle, and at least one bottle mount for connecting the chamber to the top of the bottle. The chamber may further comprise at least one vent aperture, which may be aligned with at least one vent hole in the skirt.

The capsule of the present invention may form a secondary closure on the bottle. The skirt may include an aperture for displaying the item through at least a top wall of the chamber. A portion of the chamber may protrude through the aperture in the skirt for displaying the item through a top wall of the chamber and also through at least one side wall of the chamber. The skirt may be formed from a thin sheet comprising one of a metal, a thermoplastic, wood pulp, or wax. The capsule may further include indicia on an inner surface of the capsule, such as on an inner surface of the skirt or under a disk that may cover the aperture.

The chamber may further comprise a housing having a cavity, an opening in the housing to permit the insertion and removal of the item into and from the cavity, and a cover releasably covering the opening to releasably secure the item inside the chamber. The skirt may include a tear strip, which may be circumferentially positioned on an inner surface of the skirt and axially below the at least one vent hole. An end of the tear strip may be exteriorly accessible to permit actuation of the tear strip. Actuation of the tear strip may release the chamber from the bottle and permit access to the cover and also to a primary closure of the bottle.

The chamber may be capable of bearing a compressive force longitudinally transmitted through the at least one standoff when the capsule is mounted on the bottle. The bottle may be one of a wine bottle, a champagne bottle, a liquor bottle, or a soda bottle.

In another embodiment, a capsule may form a secondary closure on a bottle, comprising a skirt having at least one vent hole therethrough, and a chamber positioned at least partially inside and releasably secured to at least a portion of the skirt. The chamber may comprise an item, which may be removably insertable into and from a cavity in the chamber through an opening in the chamber. The chamber may also comprise a cover removably secured to the chamber and covering the opening for releasably securing the item in the cavity, and a tear strip positioned on the skirt. An end of the tear strip may be exteriorly accessible for gripping and actuating the tear strip. Actuation of the tear strip may release the chamber from the bottle and may permit access to the cover and also to a primary closure of the bottle. The chamber may also comprise at least one vent cavity, which may be aligned with at least one vent hole.

The item may be visible through at least one wall of the chamber. The chamber may comprise a plan form that is one of a circle or a polygon. A top wall of the chamber may include a raised surface or a recessed surface. A top wall of the chamber may alternatively, or additionally, include a lens for magnifying the item.

The skirt may conformably attached to the chamber and the skirt may be transparent. The capsule may also include indicia on an inner surface of the capsule, such as on an inner surface of the skirt.

In another embodiment, the invention may comprise a system for housing an item with a bottle. The system may comprise a closure having a chamber for housing the item where the closure may be positioned in a mouth of the bottle and a cap releasably positioned on the closure and over the chamber for releasably retaining the item. The cap may include a first aperture along an outer edge of the cap to assist in removing the cap from the closure for accessing the item. The system may also comprise a skirt positioned over the closure and the cap and secured to at least a portion of the bottle.

The skirt may include a second aperture that may expose at least a portion of the cap. The cap may be transparent for displaying the item. The skirt may further comprise a second aperture exposing at least a portion of the first aperture to permit communication of gas through the first and second apertures, and a tear strip positioned on the skirt. An end of the tear strip may be exteriorly accessible for gripping and actuating the tear strip. Actuation of the tear strip may separate at least a portion of the skirt to permit access to the cap. The capsule may include indicia on an inner surface of the capsule.

Another embodiment of the present invention may comprise a punt capsule for a bottle punt. The punt capsule may comprise an inner capsule including a cavity adapted to be received by the bottle punt and a chamber positioned in the cavity for housing an item. The chamber may comprise a cover forming a bottom of the chamber wherein the cover may be releasably secured to the chamber to releasably secure the item inside the chamber. The punt capsule may further comprise an outer capsule connected to the inner capsule and enclosing the chamber in the cavity. The outer capsule may include a tear strip wherein an end of the tear strip may be exteriorly accessible for gripping and actuating the tear strip. Actuation of the tear strip may at least partially separate a portion of the outer capsule from the inner capsule to release the chamber from the punt capsule.

The inner capsule may nest in the outer capsule. The punt capsule may be inserted over and shrink-fit to a bottom of a bottle. The chamber of the punt capsule may nest in the cavity.

In another embodiment, a closure for a bottle comprises a head portion comprising a chamber for housing an item, where the chamber comprises an opening formed in a top of the head portion to provide access to the item. The head portion in this embodiment is configured to abut a rim of the bottle. The closure also comprises a stub portion extending from a bottom of the head portion, where the stub portion is resilient and forms a releasable interference fit with an inside surface of the bottle. In this way, the stub may be capable of multiple insertions into and extractions from a bottle by simply gripping the closure, rotating the closure to exceed the static friction between the stub and the bottle wall, and either inserting or extracting the stub into or from the bottle. The closure further comprises a cap releasably connectable to the head portion and over the opening for releasably retaining the item. The cap includes a protrusion extending from a bottom of the cap for engaging the opening.

The head portion may include a grip positioned on a periphery of the head portion, where the grip comprises at least one of a plurality of longitudinally oriented protrusions and a plurality of longitudinally oriented depressions. The head portion may include an approximately flat, annular surface on the bottom of the head portion for abutting the rim of the bottle and for controlling a depth of insertion of the closure in the bottle. The head portion may be integrally formed with the stub portion to form the closure.

The cap may be transparent to provide visual access to the item in the chamber. The cap may comprise a lip extending peripherally and outwardly beyond the protrusion to approximately a transition between the top and a side wall of the head portion, where a bottom edge of the lip may be accessible to pry the cap from the head portion. The cap may include a convex top surface to form a lens. The protrusion extending from the cap may comprise a bell-shaped profile having a base larger than a neck. The neck of the protrusion may engage the opening in the head portion to releasably secure the cap to the head portion. The opening in the head portion may include a lip for engaging the neck of the bell-shaped protrusion, where the lip may comprise a clearance with the neck and an interference with the base. The lip of may be resilient and cooperate with the base and the neck of the protrusion extending from the cap.

In one embodiment of the closure, at least one of the head portion and the stub portion may comprise a thermochromic property.

A better understanding of the objects, advantages, features, properties and relationships of the invention will be obtained from the following detailed description and accompanying drawings which set forth illustrative embodiments that are indicative of the various ways in which the principles of the invention may be employed.

BRIEF DESCRIPTION OF THE DRAWINGS

For a better understanding of the invention, reference may be had to preferred embodiments shown in the following drawings in which:

FIG. 20 illustrates a perspective view showing the steps of manufacture of another part of a punt capsule of the present invention;

FIG. 21 illustrates a perspective view showing the steps of manufacture of yet another part of a punt capsule of the present invention;

FIG. 22 illustrates a front elevational view of view of a part of a punt capsule using the parts shown in FIGS. 20 and 21;

FIG. 23 illustrates a front perspective view of the punt capsule of FIG. 22;

DETAILED DESCRIPTION

Figure 1:
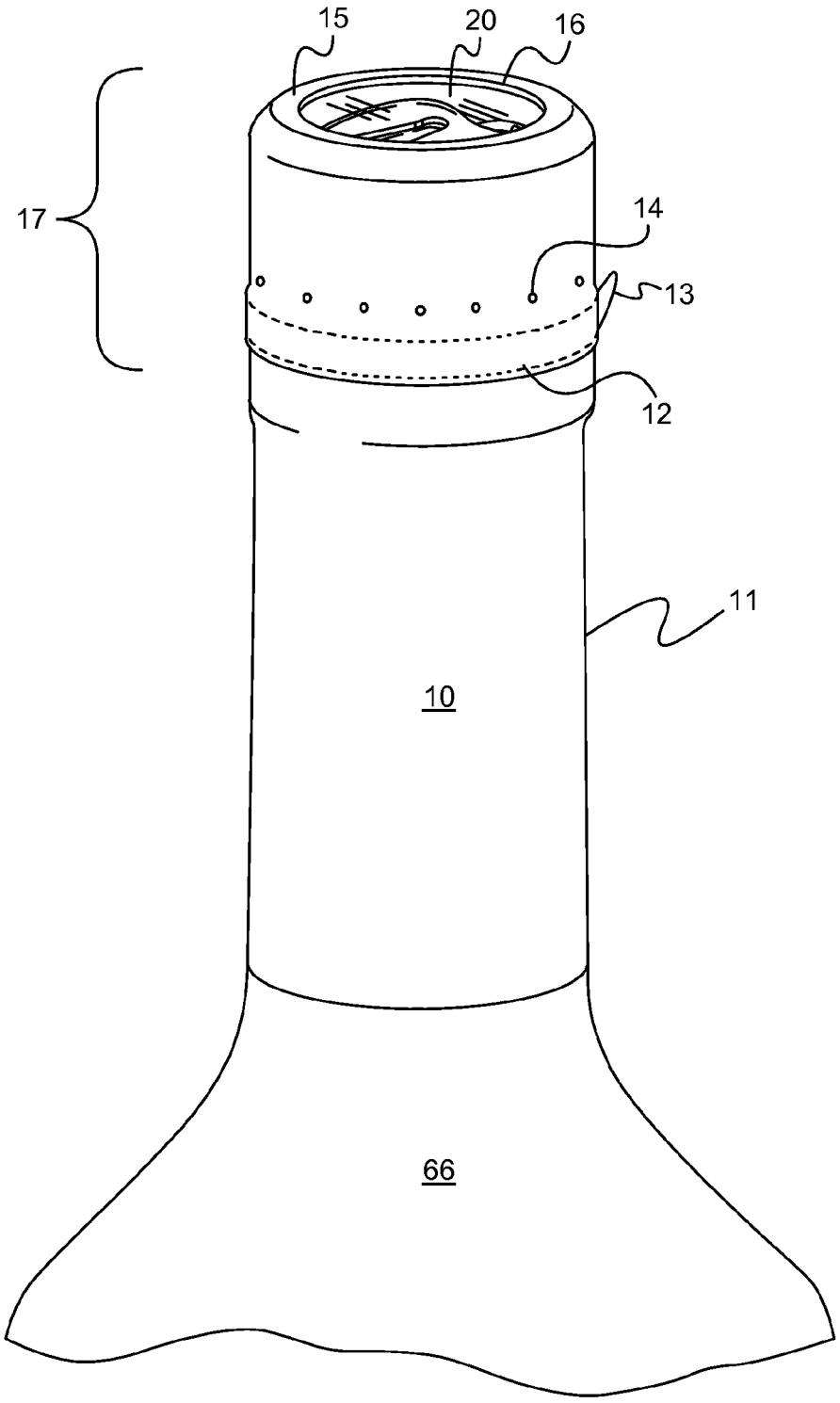
FIG. 1 illustrates a perspective view of one embodiment of the present invention.

While this invention is susceptible of embodiments in many different forms, there is shown in the drawings and will herein be described in detail, a preferred embodiment of the invention with the understanding that the present disclosure should be considered as an exemplification of the principles of the invention and is not intended to limit the broad aspects of the invention to the embodiments illustrated herein.

Turning now to the figures, wherein like reference numerals refer to like elements, there is illustrated in FIGS. 1-11 capsule 10 incorporating the improvements of the present invention. FIG. 1 illustrates, for example, one particular application out of a multitude of possible applications of capsule 10 where capsule 10 is shown installed upon the top of bottle 66, such as that commonly used for wine, champagne, liquor, beer, soda, and the like. Capsule 10 may include skirt 11 and chamber 20. Capsule 10 may contain and may display item 46, which may include, for example, a promotional item, a charm, a trinket, or the like, within chamber 20 positioned inside capsule 10 or simply positioned inside or underneath skirt 11 if chamber 20 is not present. In addition, capsule 10 may act as a secondary closure for the contents of the bottle in addition to primary closure 60 of bottle 66, such as a cork (see FIG. 5) or a cap (not shown), to secure the contents of bottle 66, such as a beverage, inside bottle 66.

Figure 2:
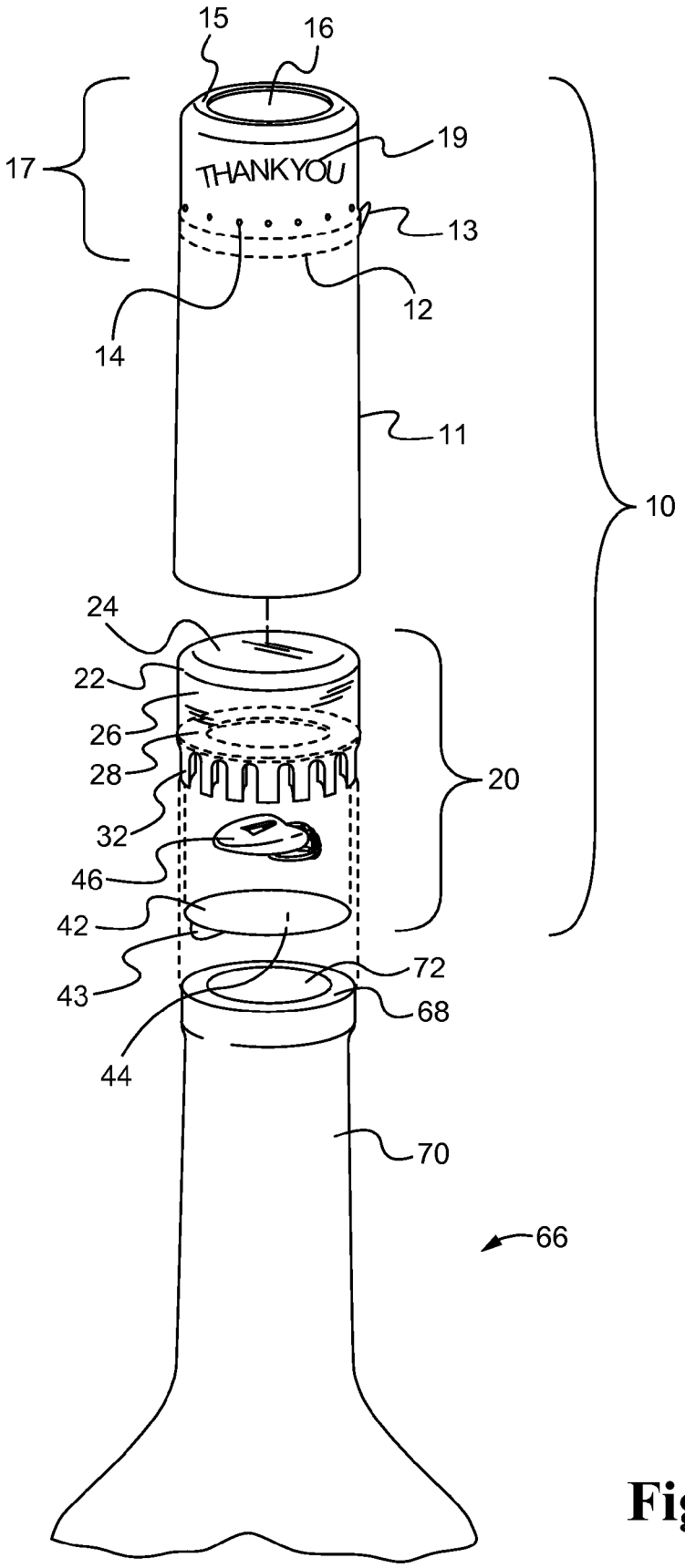
FIG. 2 illustrates an exploded perspective view of the embodiment of FIG. 1.
Figure 3:
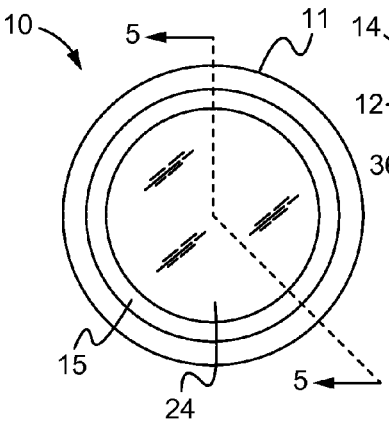
FIG. 3 illustrates a top plan view of the embodiment of FIG. 1.

Skirt 11 of capsule 10 may be made from a variety of suitable materials, such as, for example, metal, including aluminum or tin, a thermoplastic, such as polystyrene, polyethylene, polypropylene or ABS, wood pulp, wax, or any other material that may be formed into and function as a capsule. Skirt 11 may be fabricated to substantially conform to at least a portion of chamber 20 and to bottle 66, such as neck 70, and may include wall 15 forming aperture 16 for the retainable housing and optional display of the contents of chamber 20. For example, as shown in FIG. 2, skirt 11 may be fabricated in the shape of a tube for insertion over chamber 20 and neck 70 of bottle 66. Skirt 11 may be secured to and substantially conform to at least a portion of chamber 20 and to bottle 66, over the entirety of bottle 66 or over any portion of bottle 66, such as neck 70, using conventional means, such as by shrinking skirt 11 using heat or by compressing skirt 11 under pressure to conform to bottle 66, or both. An adhesive may also be used, if desired, to more securely attach skirt 11 to neck 70. Skirt 11 may be transparent, semi-transparent, or opaque.

To permit the optional visual access to item 46 while housed in chamber 20, aperture 16 of skirt 11 may reveal chamber 20 and its contents. Chamber 20 may include housing 22, which may include top surface 24. If visibility of item 46 while housed in chamber 20 is desired, at least top surface 24 of housing 22 may be transparent or semi-transparent and may be left exposed to and visible through aperture 16 in skirt 11 to permit display of item 46. Housing 22 of chamber 20 may instead be opaque to obscure display of item 46. Alternatively, skirt 11 of capsule 10 may, in addition to or in place of chamber 20, include a transparent, semi-transparent, or opaque disk or other cover that spans aperture 16 to display, obscure, or prevent display of item 46. Skirt 11 of capsule 10 may optionally not include aperture 16 and instead may completely cover chamber 20. However, a completely covered chamber 20 may still be visible depending on the chosen transparency of skirt 11.

It is understood by one of ordinary skill in the art that housing 22 of chamber 20 may be made in any shape. For example, as shown in FIG. 2, housing 22 may be generally circular on its periphery. Alternatively, housing 22 may be made in the shape of, for example, a polygon. Likewise, top surface 24 may be generally flat, as shown in FIG. 2 or take on any shape, such as a dome, for example, and may include a raised impression, a depression, or a lens for magnifying item 46.

As shown in FIGS. 1-2, capsule 10 may also include at least one vent hole 14, which may be radially positioned along the perimeter of, and through, skirt 11 for communicating gas through skirt 11. If more than one vent hole 14 is included, as may be determined, for example, by the contents of bottle 66 and the porosity and/or permeability of primary closure 60 or for ease of installation of skirt 11 over bottle 66, vent holes 14 may be spaced equidistant from one another, or they may be spaced with irregular spacing to maximize potential alignment with other features of the invention, as described below, for communicating gas through skirt 11. The at least one vent hole 14 may be positioned above mouth 72 of bottle 66 to permit transmission of gas through skirt 11.

Figure 5:
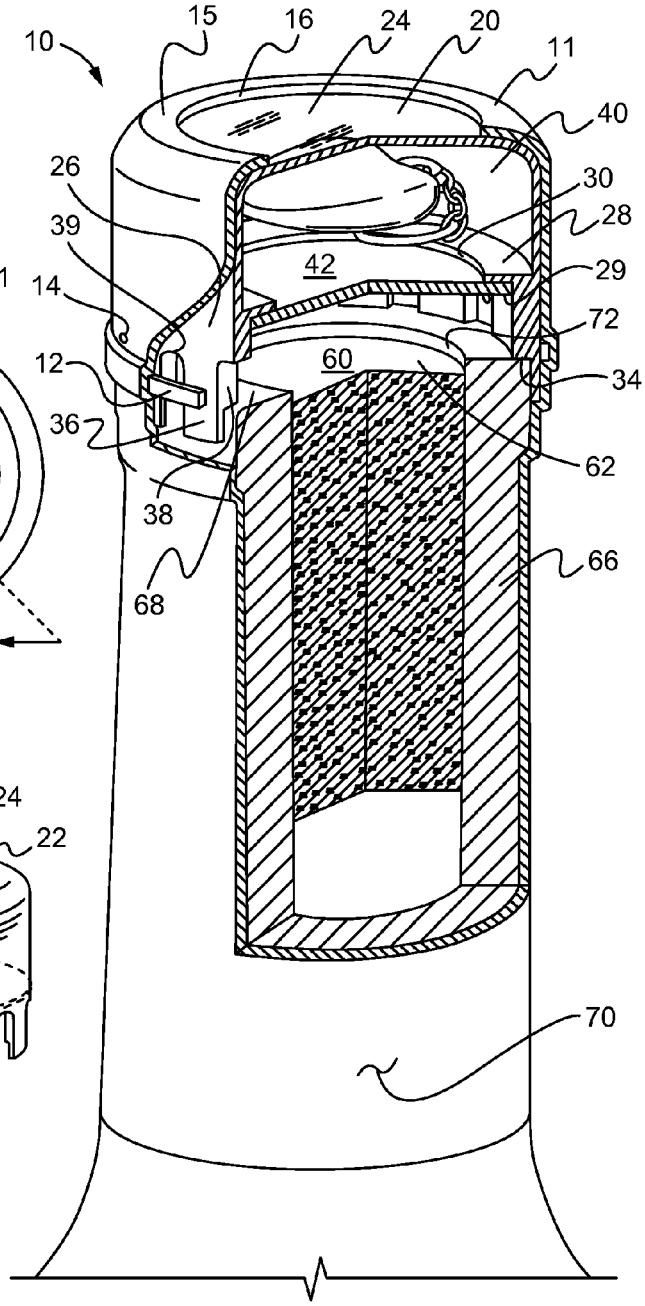
FIG. 5 illustrates a partial section view, in perspective, of the embodiment of FIG. 1.
Figure 6:
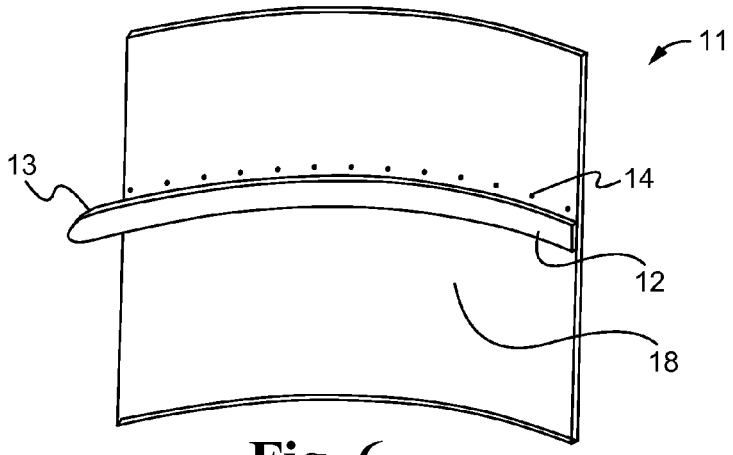
FIG. 6 illustrates a rear perspective view of a skirt of the embodiment of FIG. 1.
Figure 7:
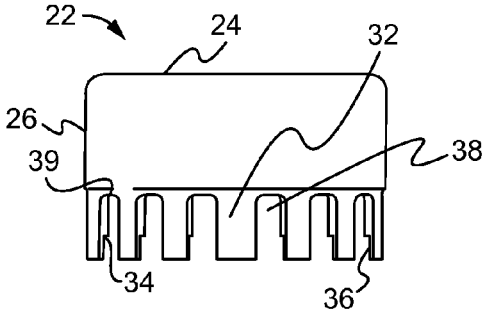
FIG. 7 illustrates a front elevational view of a housing of the embodiment of FIG. 1.
Figure 8:
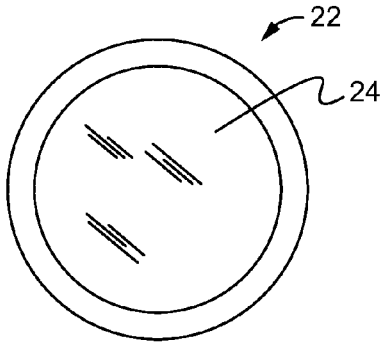
FIG. 8 illustrates a top plan view of the housing of FIG. 7.
Figure 9:
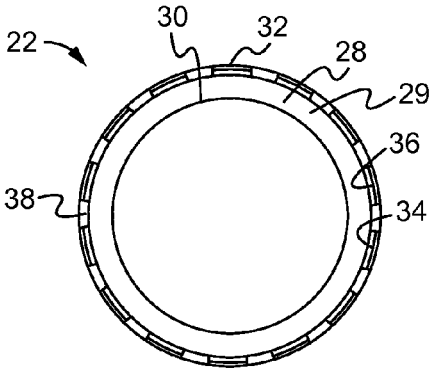
FIG. 9 illustrates a bottom plan view of the housing of FIG. 7.
Figure 10:
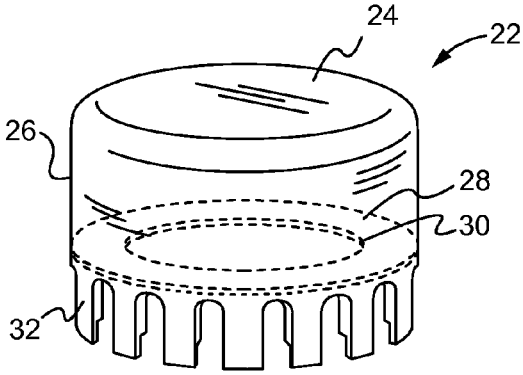
FIG. 10 illustrates a front perspective view of the housing of FIG. 7.

Capsule 10 may optionally include tear strip 12 affixed to inside surface 18 of skirt 11 (see FIG. 6). Tear strip 12 may provide a convenient method for partially or completely severing top portion 17 of skirt 11 from skirt 11 to release chamber 20 from bottle 66 and to permit access to both the contents of chamber 20 (i.e., item 46) as well as to primary closure 60 of bottle 66, such as a cork (see FIG. 5) or a cap (not shown). Alternatively, if tear strip 12 is not included in capsule 10, top portion 17 may be separated from capsule 10 using any conventional tool for such purpose. However, using such additional tool may be more expensive to acquire and cumbersome to deploy as compared to using the features disclosed in the present invention. Alternatively, skirt 11 may instead be configured to be removed by hand by, for example, simply pulling or peeling skirt 11 off of bottle 66.

Tear strip 12 may be oriented substantially circumferentially on inside surface 18 at a position below the at least one vent hole 14, as shown in FIGS. 1-2 to permit partial or complete removal of at least top portion 17 of capsule 10, or possibly the entirety of capsule 10, if desired, from bottle 66 while also permitting venting of gas from inside bottle 66. Tear strip 12 may optionally be positioned near bottle top 68 to release chamber 20 and to provide a torn edge of skirt 11 approximately at or below bottle top 68. Alternatively, tear strip 12 may be oriented in any one of a number of different orientations, such as in a helical pattern, a zig-zag pattern, or a substantially longitudinal (vertical) orientation to permit partial or complete removal of top portion 17, and perhaps the entirety, of capsule 10 from bottle 66. Tear strip 12 may be a separate piece that is affixed to inside surface 18 of skirt 11 or tear strip 12 may be integrally formed with skirt 11. If tear strip 12 is a separate piece, fear strip 12 may be made from a different material than skirt 11.

As shown in FIG. 2, capsule 10 may also include indicia 19 positioned on an inner surface of capsule 10, such as on inside surface 18 of skirt 11, underneath a disk (not shown) or other cover that may cover aperture 16, on bottom surface 44 of peel strip 42, or separately included under chamber 20. In this way, hidden messages may be provided to and read by, for example, consumers of bottle 66 after releasing chamber 20 from skirt 11.

Figure 4:
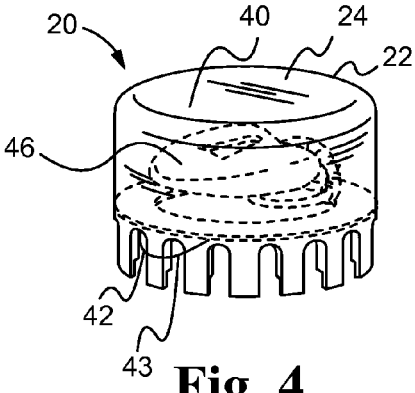
FIG. 4 illustrates a chamber of the embodiment of FIG. 1.

As best shown in FIGS. 2, 4 and 5, chamber 20 of capsule 10 may include housing 22, item 46 and peel strip 42. Peel strip 42 may be adhesively secured to underside surface 29 of bottom wall 28 of housing 22 to fully encapsulate item 46 to prevent intrusion of potentially corrosive moisture or gas from entering chamber 20 and damaging item 46. Alternatively, peel strip 42 may comprise any form of closure or cover to simply cover opening 30 and to contain item 46. Chamber 20 may also be pre-assembled with item 46 and with peel strip 42 for ease of manufacture of capsule 10.

As shown in FIG. 5, capsule 10 may form a secondary closure over primary closure 60. Primary closure 60 may be inserted into mouth 72 of bottle 66 using conventional means. Once installed, top surface 62 of primary closure 60 may be either above, below, or flush with bottle top 68 of bottle 66 so long as gas is permitted to pass through at least one of vent holes 14.

As shown in FIGS. 7-10, housing 22 may include opening 30 to permit installation and removal of item 46 into and from cavity 40 of housing 22. Housing 22 may also include at least one standoff 32. The at least one standoff 32 may extend approximately from bottom wall 28 of housing 22, and may include at least one bottle mount 34 for connecting chamber 20 to bottle top 68, at least one rim guide for centering chamber 20 on bottle 66, and at least one vent cavity 38. The at least one vent cavity 38 may be oriented to align with the at least one vent hole 14 for communicating gas through the at least one vent hole 14 arranged in skirt 11 of capsule 10. Depending on the number of vent cavities 38 included in housing 22, each of vent cavities 38 may be spaced equidistant from one another, or they may be spaced with irregular spacing to maximize the possibility that at least one vent cavity 38 aligns with at least one vent hole 14 to permit passage of gas, for example, from within inside bottle 66 to the atmosphere.

Figure 11:
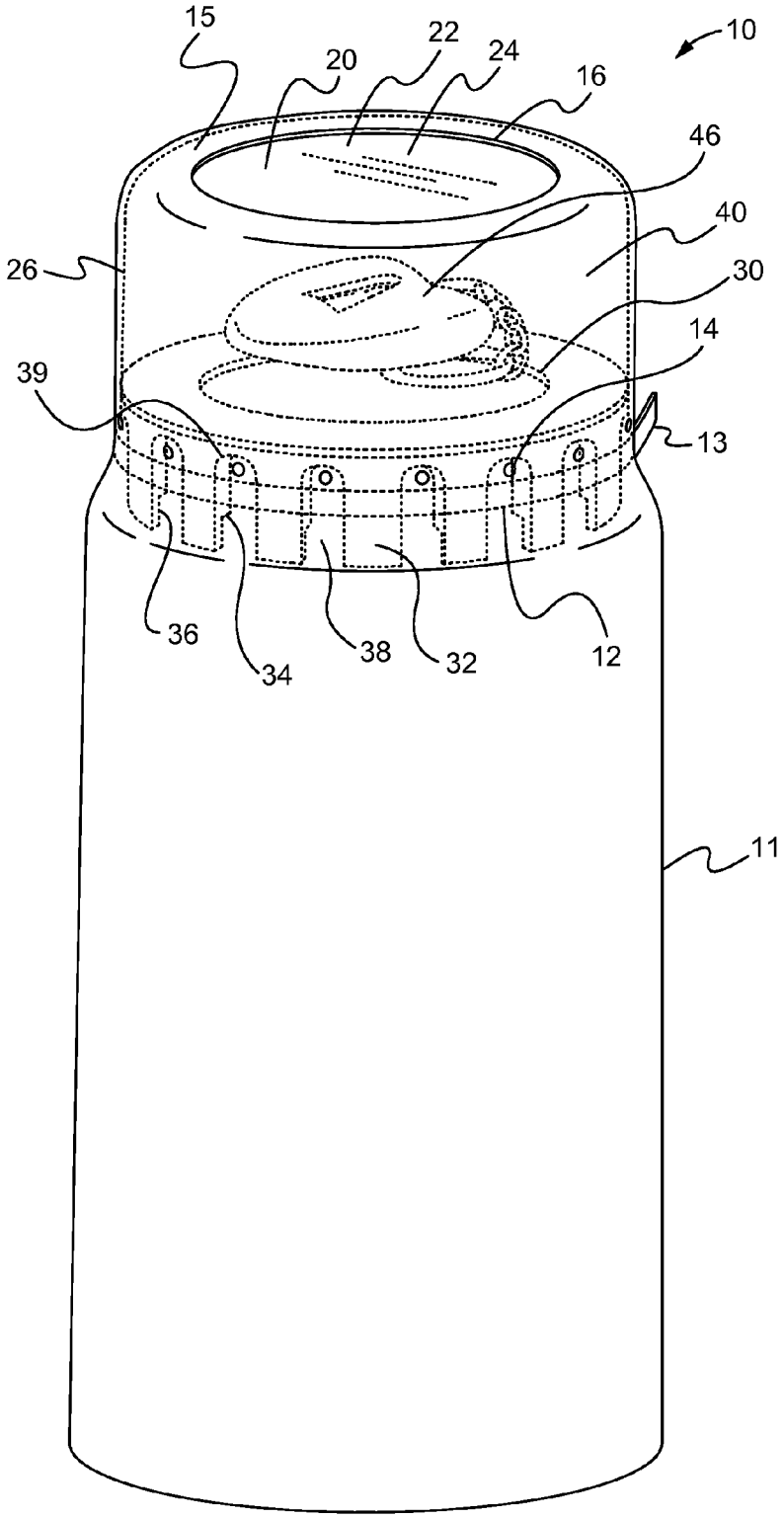
FIG. 11 illustrates a perspective view of a capsule of the embodiment of FIG. 1.

FIG. 11 shows a complete capsule 10 ready for final installation on bottle 66. Specifically, capsule 10 is shown with chamber 20 inserted into and affixed to inside surface 18 of skirt 11 using conventional means, such as by shrinking skirt 11 using heat or by compressing skirt 11 under pressure to conform to chamber 20, or both. Alternatively or additionally, skirt 11 may be pre-formed into the general shape shown in FIG. 11 and simply adhered to chamber 20 using an adhesive. In either case, skirt 11 may not initially be shrunk below chamber 20 to permit later insertion of capsule 10 over neck 70 of bottle 66.

A method for using capsule 10 shown in FIG. 11 includes first installing capsule 10 onto neck 70 of bottle 66. Rim guides 36 may assist in the assembly process by helping to center chamber 20 over bottle top 68 until contact is made between bottle mounts 34 of chamber 20 onto bottle top 68. Capsule 10 may then be secured onto neck 70 by conventional means, such as by shrinking skirt 11 using heat or by compressing skirt 11 of capsule 10 under pressure to conform to neck 70, or both. Additionally, capsule 10 may be adhered to neck 70 using an adhesive. Once installed upon bottle 66, capsule 10 and particularly chamber 20 may be capable of bearing a compressive force longitudinally transmitted through the at least one standoff 32.

If a user wishes to access item 46 from within chamber 20 when capsule 10 is fully installed on bottle 66, the user must first tear or score skirt 11 to release chamber 20 from capsule 10 and bottle 66. To tear skirt 11, a user may grip loose end 13 of tear strip 12, which may extend exteriorly through, for example, either a longitudinal seam in skirt 11 or through an opening in skirt 11, and pull tear strip 12 to rupture skirt 11 along the periphery of skirt 11 until chamber 20 is released. In so doing, a torn edge of skirt 11 may be formed approximately at or below bottle top 68. Alternatively, to release chamber 20 in cases when tear strip 12 is not present on capsule 10, a sharp knife or other tool known to one of ordinary skill can be used to tear, cut, score or otherwise cleave skirt 11 along the periphery of skirt 11. However, using such additional tool may be more expensive to acquire and cumbersome to deploy as compared to using the features disclosed in the present invention. Alternatively, skirt 11 may instead be configured to be removed by hand by, for example, simply pulling or peeling skirt 11 off of bottle 66.

Once chamber 20 is released from capsule 10 on bottle 66, the contents of chamber 20 may be accessed by gripping loose end 43 of peel strip 42 (see FIG. 2, for example) and peeling or removing peel strip 42 away from bottom wall 28 of housing 22. Item 46 may then be retrieved through opening 30 of housing 22. In addition, once chamber 20 is released from capsule 10 on bottle 66, primary closure 60 of bottle 66, such as a cork (see FIG. 5) or a cap (not shown), may also be accessed and removed using conventional means to gain access to the contents of bottle 66.

Figure 12:
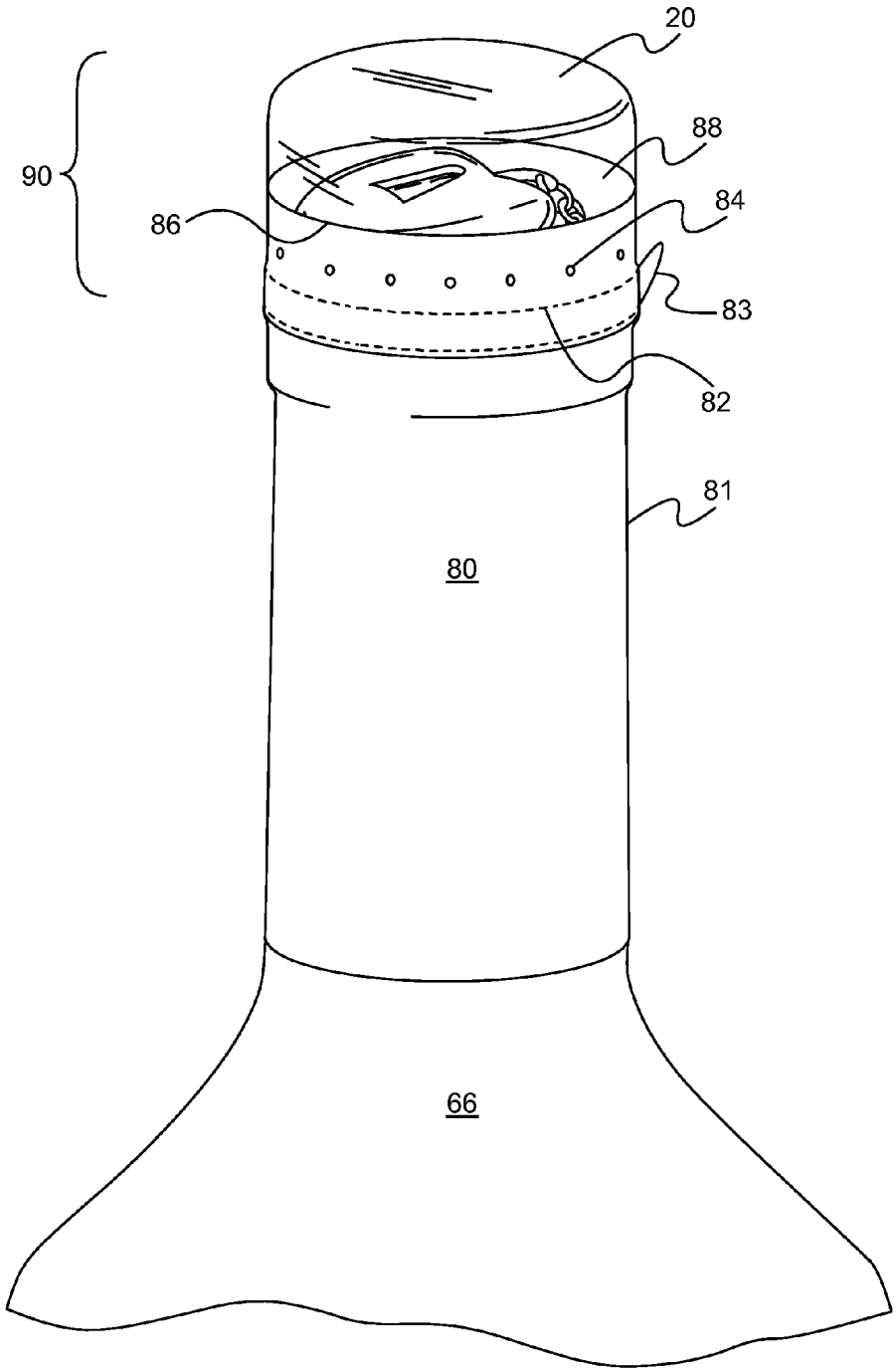
FIG. 12 illustrates a perspective view of another embodiment of the present invention.
Figure 13:
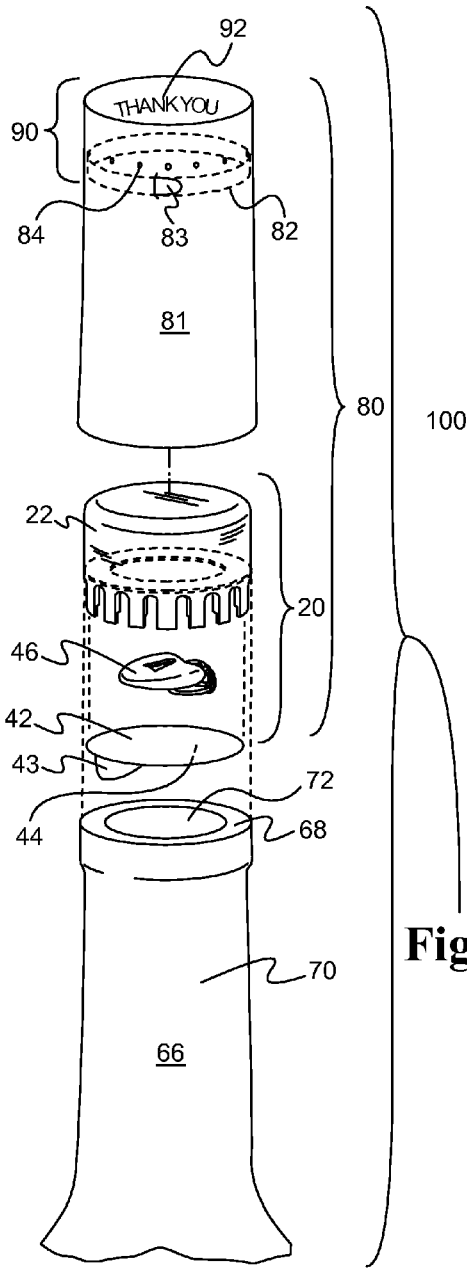
FIG. 13 illustrates an exploded perspective view of the embodiment of FIG. 12.

FIGS. 12-13 show another embodiment of the invention. Skirt 81 of this embodiment has properties and features similar to skirt 11 described above except that chamber 20 may protrude or extend past opening 86 of skirt 81 to reveal top surface 24 and at least one side wall 26 of housing 22 of chamber 20 to further enhance visibility of item 46. Chamber 20 may also be inserted into skirt 81 and affixed or secured to inner surface 88 of skirt 81 in the same manner as described above for the embodiment of FIGS. 1-11. For example, chamber 20 may be secured to inner surface 88 of skirt 81 using conventional means, such as by shrinking skirt 81 using heat or by compressing skirt 81 under pressure to conform to chamber 20, or both. An adhesive may also be used, if desired, to more securely attach chamber 20 to skirt 81 in capsule 80.

Capsule 80 in FIG. 12 may also include at least one vent hole 84, which may be radially positioned along the perimeter of, and through, skirt 81 for communicating gas through skirt 81. If more than one vent hole 84 is included, as may be determined, for example, by the contents of bottle 66 and the porosity, the permeability of primary closure 60, or for ease of installation of skirt 11 over bottle 66, vent holes 84 may be spaced equidistant from one another, or they may be spaced with irregular spacing to maximize potential alignment with other features of the invention, as described below, for communicating gas through skirt 81. The at least one vent hole 84 may be positioned above mouth 72 of bottle 66 to permit transmission of gas through skirt 81.

Chamber 20 may be released from capsule 80 in the same manner as described above for the embodiment of FIGS. 1-11. Specifically, skirt 81 may optionally include tear strip 82 affixed to inner surface 88 of skirt 81 and loose end 83 for gripping and actuating tear strip 82. Tear strip 82 may provide a convenient method for partially or completely separating top portion 90 of skirt 81 from skirt 81 to release chamber 20 from bottle 66 and to permit access to both the contents of chamber 20 (i.e., item 46) as well as to primary closure 60 of bottle 66, such as a cork (see FIG. 5) or a cap (not shown). Alternatively, if tear strip 82 is not included in capsule 80, top portion 90 may be separated from capsule 80 using any conventional tool for such purpose. However, using such additional tool may be more expensive to acquire and cumbersome to deploy as compared to using the features disclosed in the present invention. Alternatively, skirt 81 may instead be configured to be removed by hand by, for example, simply pulling or peeling skirt 81 off of bottle 66.

Like the embodiment of FIGS. 1-11, tear strip 82 shown in FIGS. 12-13 may be oriented substantially circumferentially on inner surface 88 at a position below the at least one vent hole 84 to permit removal of at least top portion 90 of capsule 80, or possibly the entirety of capsule 80, if desired, from bottle 66 while also permitting venting of gas from inside bottle 66. Tear strip 82 may optionally be positioned near bottle top 68 to release chamber 20 and to provide a torn edge of skirt 81 approximately at or below bottle top 68. Alternatively, tear strip 82 may be oriented in any one of a number of different orientations, such as in a helical pattern, a zig-zag pattern, or a substantially longitudinal (vertical) orientation to permit removal of at least top portion 90, and perhaps the entirety, of capsule 80 from bottle 66. Tear strip 82 may be a separate piece that is affixed to inner surface 88 of skirt 81 or tear strip 82 may be integrally formed with skirt 81. If tear strip 82 is a separate piece, tear strip 82 may be made from a different material than skirt 81.

As shown in FIG. 13, capsule 80 may also include indicia 92 positioned on an inner surface of capsule 80, such as on inner surface 88 of skirt 81, on bottom surface 44 of peel strip 42, or separately included under chamber 20. In this way, hidden messages may be provided to and read by, for example, consumers of bottle 66 after releasing chamber 20 from skirt 81.

It should be understood that the method for using capsule 80, and for displaying and removing item 46 from chamber 20 is generally the same as described above for the embodiment of FIGS. 1-11.

Figure 14:
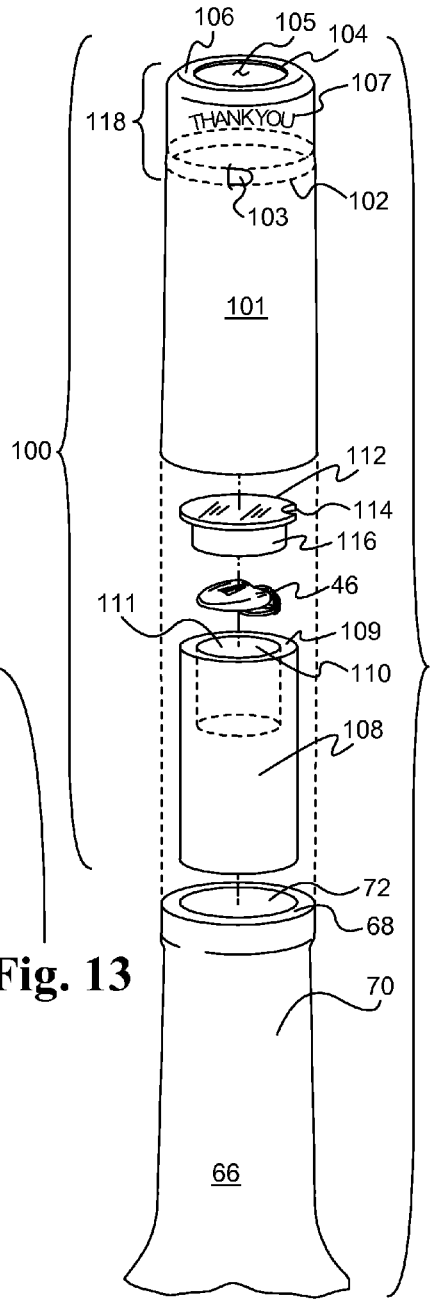
FIG. 14 illustrates an exploded perspective view of yet another embodiment of the present invention.

Yet another embodiment of the present invention is shown in FIG. 14. In this embodiment, capsule 100 may include primary closure 108, item 46, cap 112 and skirt 101. Primary closure 108 may include chamber 110 for housing item 46. Chamber 110 may be concentrically drilled, bored, or molded into primary closure 108. For best results, given the geometry of chamber 110, primary closure 108 may comprise a synthetic material to reduce porosity of primary closure 108 and to provide sufficient radial wall loads to at least prevent leakage of fluid from inside bottle 66.

As shown in FIG. 14, primary closure 108 may be inserted into mouth 72 of bottle 66 using conventional means. Once installed, top surface 109 of primary closure 108 may be any one of approximately below, flush, or above bottle top 68 of bottle 66. Item 46 may be inserted into chamber 110 either before or after installation of primary closure 108 into mouth 72. If chamber 110 is inserted before primary closure 108 is inserted into mouth 72, then a temporary closure may be employed to retain item 46 in chamber 110.

To secure item 46 inside chamber 110, cap 112 may be inserted into and over chamber 110. To accomplish this, cap 112 may include outer wall 116, which may form an interference fit with inner wall 111 of chamber 110 upon insertion of outer wall 116 of cap 112 inside chamber 110. An adhesive may also be used, if desired, anywhere cap 112 adjoins primary closure 108 to seal item 46 from atmospheric dirt and contamination. To secure cap 112 to chamber 110, skirt 101 of capsule 100 may include wall 106. Skirt 101 may include aperture 104, which may be smaller in size than cap 112.

To permit the optional visual access to item 46 while housed in chamber 110, aperture 104 of skirt 101 may reveal chamber 110 and its contents through optional cap 112. Skirt 101 of capsule 100 may also include a transparent, semi-transparent, or opaque disk or other cover that spans aperture 104 to display, obscure, or prevent display of item 46 and to secure item 46 in chamber 110 if cap 112 is not present. Skirt 101 of capsule 100 may optionally not include aperture 104 and instead may completely cover chamber 110. However, a completely covered chamber 110 may still be visible depending on the chosen transparency of skirt 101.

To gain access to cap 112 and item 46, skirt 101 of capsule 100 may include tear strip 102 affixed or secured to inner surface 105 of skirt 101. Tear strip 102, and loose end 103 usable for gripping and actuating tear strip 102, may provide a convenient method for partially or completely separating top portion 118 of skirt 101 from skirt 101 to access cap 112 and to permit access to both the contents of chamber 110 (i.e., item 46) as well as to primary closure 108 of bottle 66. Alternatively, if tear strip 102 is not included with capsule 100, top portion 118 may be separated from capsule 100 using any conventional tool for such purpose. However, using such additional tool may be more expensive to acquire and cumbersome to deploy as compared to using the features disclosed in the present invention. Alternatively, skirt 101 may instead be configured to be removed by hand by, for example, simply pulling or peeling skirt 101 off of bottle 66.

Like the embodiment of FIGS. 1-11, tear strip 102 shown in FIG. 14 may be oriented substantially circumferentially on inner surface 105 to permit removal of at least top portion 118 of capsule 100, or possibly the entirety of capsule 100, if desired, from bottle 66. Tear strip 102 may optionally be positioned near bottle top 68 to provide a torn edge of skirt 101 approximately at or below bottle top 68. Alternatively, tear strip 102 may be oriented in any one of a number of different orientations, such as in a helical pattern, a zig-zag pattern, or a substantially longitudinal (vertical) orientation to permit removal of at least top portion 118, and perhaps the entirety, of capsule 100 from bottle 66. Tear strip 102 may be a separate piece that is affixed to inner surface 105 of skirt 101 or tear strip 102 may be integrally formed with skirt 101. If tear strip 102 is a separate piece, tear strip 102 may be made from a different material than skirt 101.

As shown in FIG. 14, capsule 100 may also include indicia 107 positioned on an inner surface of capsule 100, such as on inner surface 105 of skirt 101, underneath a disk (not shown) or other cover that may cover aperture 104, or separately included under cap 112. In this way, hidden messages may be provided to and read by, for example, consumers of bottle 66 after removing top portion 118 from skirt 101.

To gain access to item 46 housed in chamber 110, cap 112 may also include aperture 114 positioned along a portion of the outer edge of cap 112. To remove cap 112 from primary closure 108, an object, such as a fingernail or even a screw driver, may be inserted into aperture 114 to pry cap 112 off of primary closure 108 using lever action.

Skirt 101 of this embodiment may have properties and features similar to skirt 11 described above, except that skirt 101 may not necessarily include any vent holes along its periphery, such as vent holes 14 shown on FIG. 1. Instead, gas may permeate to/from the contents of bottle 66 past or through primary closure 108, through aperture 114 of cap 112, and through aperture 104 of skirt 101.

Figure 15:
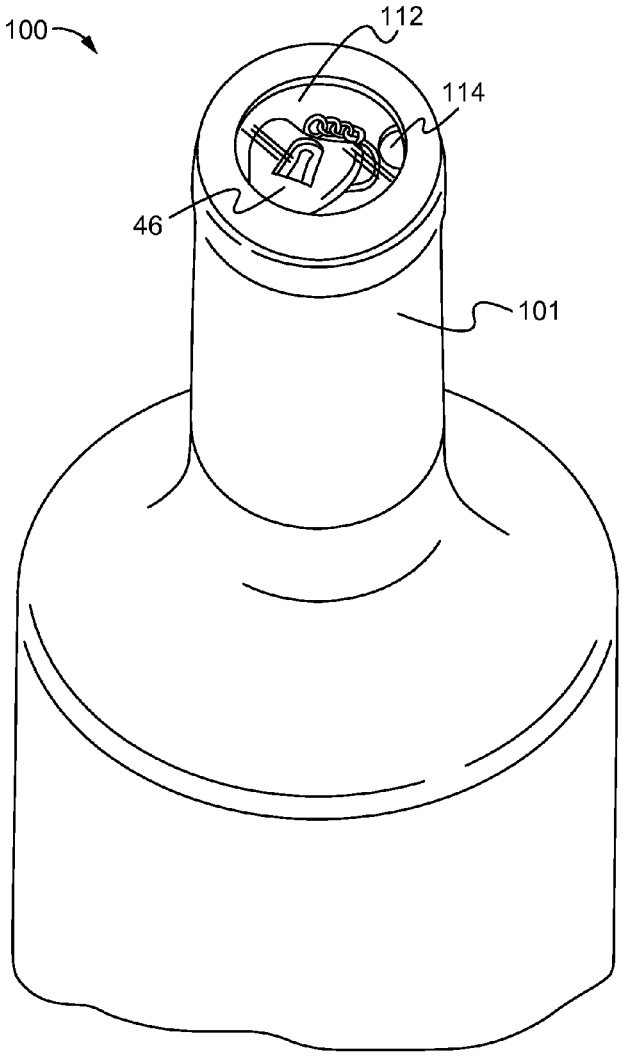
FIG. 15 illustrates a perspective view of the embodiment of FIG. 14.

In FIG. 15 there is shown a complete capsule 100, which may be formed by installing and securing skirt 101 over neck 70 of bottle 66 using conventional means, such as by shrinking skirt 101 using heat or by compressing skirt 101 under pressure to conform to neck 70 of bottle 66, or both. An adhesive may also be used, if desired, to more securely attach skirt 101 to neck 70. As shown in FIG. 15, cap 112 may be transparent to optimize visibility of item 46. However, cap 112 may be semi-transparent or opaque to obscure visibility of item 46. Alternatively, cap 112 may be covered altogether with yet another cap, cover, or disk, as described above, to partially or completely prevent visibility of item 46.

In yet another embodiment of the present invention shown in FIGS. 16-26, punt capsule 150 may alternatively be placed over bottle punt cavity 74 to house and/or display item 204, which may include a promotional item, a charm, a trinket, or the like. To provide punt capsule with the capability of housing and easily releasing item 204 from punt capsule 150, punt capsule 150 may optionally be formed from the following major components: inner capsule 152, outer capsule 180, and chamber 200. Inner capsule 152 may include skirt 154 and bottom 158.

Figure 16:
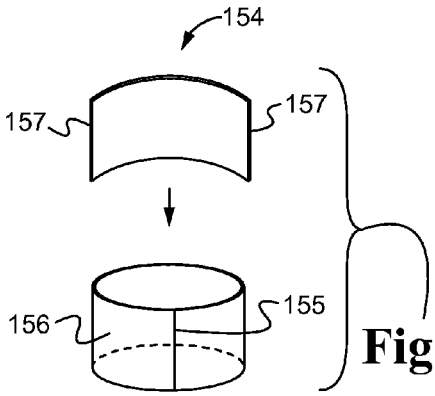
FIG. 16 illustrates a perspective view showing the steps of manufacture of one part of a punt capsule of the present invention.

As shown in FIG. 16, skirt 154 of inner capsule 152 may initially comprise a thin, transparent, semi-transparent, or opaque sheet, which may be one of a variety of suitable materials, such as, for example, metal, including aluminum or tin, a thermoplastic, such as polystyrene, polyethylene, polypropylene or ABS, wood pulp, wax, or any other material that may be formed into and function as a capsule. As shown in FIGS. 16-19, skirt 154 may be formed into a thin-walled cylinder having vertical seam 155 where side edges 157 may join and/or overlap. Adhesive may be used to connect side edges 157 to one another.

Figure 17:
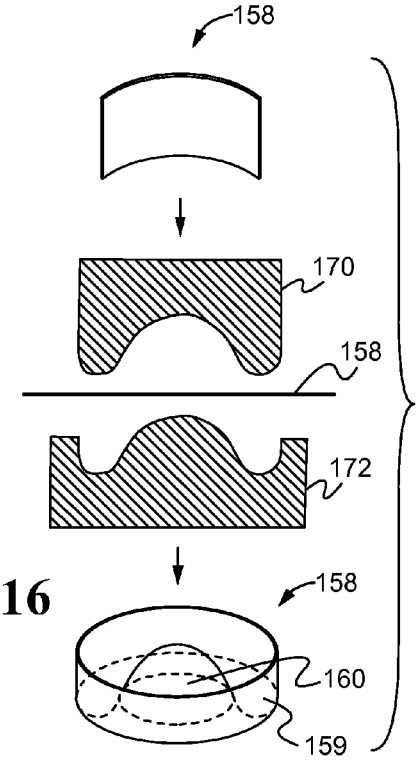
FIG. 17 illustrates a perspective view showing the steps of manufacture of another part of a punt capsule of the present invention.

As shown in FIG. 17, bottom 158 may initially comprise a relatively thin, transparent, semi-transparent, or opaque sheet, which, like skirt 154, may be one of a variety of suitable materials, such as, for example, metal, including aluminum or tin, a thermoplastic, such as polystyrene, polyethylene, polypropylene or ABS, wood pulp, wax, or any other material that may be formed into and function as a capsule. Using die set 170 and 172 or similar, bottom 158 may be press-formed having a shallow cup-like shape and having cavity 160 formed underneath bottom 158. Optionally, cavity 160 may approximately conform to the profile of the punt cavity of bottle 66.

Figure 18:
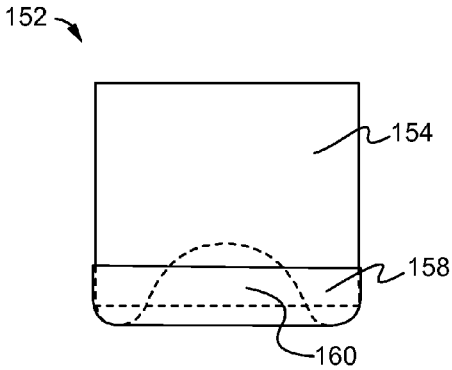
FIG. 18 illustrates a front elevational view of a part of a punt capsule using the parts shown in FIGS. 16 and 17.
Figure 19:
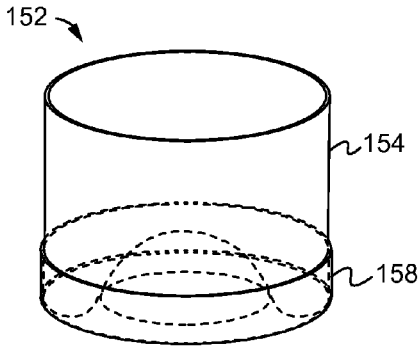
FIG. 19 illustrates a front perspective view of the punt capsule of FIG. 18.
Figure 24:
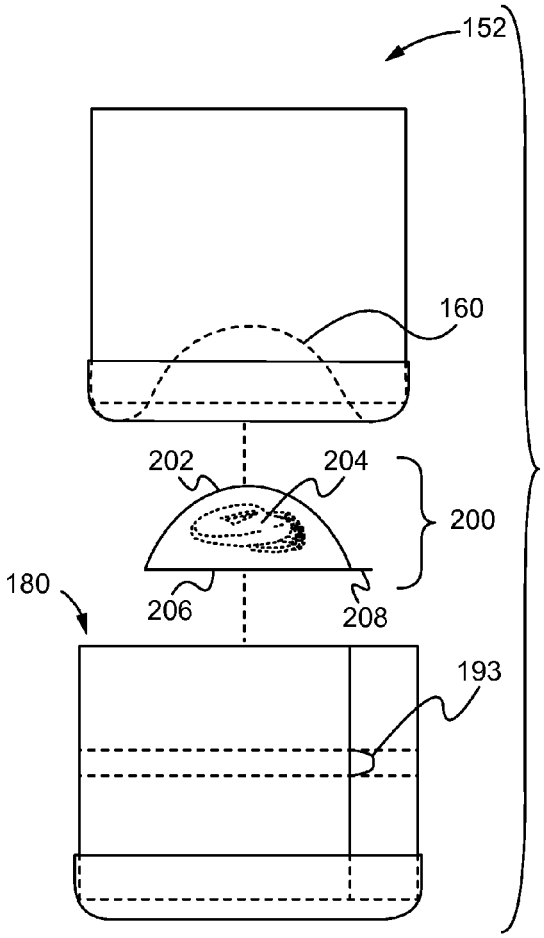
FIG. 24 illustrates an exploded front elevational view showing installation of an embodiment of a chamber together with the parts of the punt capsule shown in FIGS. 19 and 23.
Figure 25:
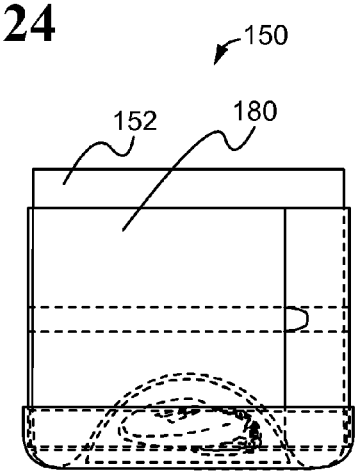
FIG. 25 illustrates a front elevational view showing the fully assembled punt capsule of FIG. 24.

Inner capsule 152, shown in FIGS. 18-19, may be formed by inserting skirt 154 inside bottom 158 and joining the two components using the techniques described above, such as by shrinking side wall 159 of bottom 158 to outer wall 156 of skirt 154 using heat or by compressing side wall 159 against outer wall 156 under pressure to fasten the parts together. An adhesive may also be used, if desired, to more securely attach skirt 154 to bottom 158.

As shown in FIGS. 20-23, outer capsule 180 may include skirt 182 and base 188. Like skirt 154, skirt 182 of outer capsule 180 may initially comprise a thin, transparent, semi-transparent, or opaque sheet, which may be one of a variety of suitable materials, such as, for example, metal, including aluminum or tin, a thermoplastic, such as polystyrene, polyethylene, polypropylene or ABS, wood pulp, wax, or any other material that may be formed into and function as a capsule. And similar to skirt 154, skirt 182 may be formed into a thin-walled cylinder having vertical seam 186 where side edges 187 may join and/or overlap. Adhesive may be used to connect side edges 187 to one another.

Skirt 182 may differ from skirt 154 in that skirt 182 may also include tear strip 185 affixed circumferentially along inner surface 183 of skirt 182. Tear strip 185 may be a separate piece that is affixed to inner surface 183 of skirt 182 or tear strip 185 may be integrally formed with skirt 185. If tear strip 185 is a separate piece, tear strip 185 may be made from a different material than skirt 185.

Similarly to bottom 158, as shown in FIG. 21, base 188 of outer capsule 180 may initially comprise a relatively thin, transparent, semi-transparent, or opaque sheet, which, like bottom 158, may be one of a variety of suitable materials, such as, for example, metal, including aluminum or tin, a thermoplastic, such as polystyrene, polyethylene, polypropylene or ABS, wood pulp, wax, or any other material that may be formed into and function as a capsule. Using die set 130 and 132 or similar, base 188 may be press-formed into a shallow cup-like shape having a generally flat bottom wall 189 and a generally circular plan form.

Outer capsule 180, shown in FIGS. 22-23, may be formed by inserting skirt 182 inside base 188 and joining the two components using the techniques described above, such as by shrinking side wall 190 of base 188 to outer wall 184 of skirt 182 using heat or by compressing side wall 190 against outer wall 184 under pressure to fasten the parts together. An adhesive may also be used, if desired, to more securely attach skirt 182 to base 188.

Chamber 200 may house item 204 for optional display in the punt cavity of bottle 66 and may comprise a self-contained package for installation into punt capsule 150. Chamber 200 may be made from any transparent, semi-transparent, or opaque material, such as for example, a metal, a thermoplastic, or glass. In addition, chamber 200 may include surface 202 and peel strip 206. Surface 202 may optionally conform to the profile of cavity 160, which, as described above, may optionally conform to the profile of the punt cavity of bottle 66. Peel strip 206 may form a closure for chamber 200, and may include an adhesive so as to adhere peel strip 206 to surface 202 of chamber 200. Peel strip 206 may comprise any form of closure or cover sufficient to enclose and retain item 204. Peel strip 206 or other closure for chamber 200 may be fabricated from the same material as surface 202 and may, for example, be attached to chamber 200 using conventional methods, such as by hinging, to create an opening for insertion and removal of item 204. Chamber 200 may also be pre-assembled with item 204 and with peel strip 206 or other closure for ease of manufacture of punt capsule 150. It should be understood that chamber 200 may comprise any number of geometries, configurations, and features so long as item 204 may be housed in releasable storage in the punt cavity of bottle 66.

Punt capsule 150 may be formed by first inserting chamber 200 in cavity 160 of bottom 158 of inner capsule 152. Depending on the shape of chamber 200 and cavity 160 of bottom 158, surface 202 of chamber 200 may nest with cavity 160. Once chamber 200 is inserted in cavity 160, inner capsule 152 may be joined with outer capsule 180 using the techniques described above, such as by shrinking outer capsule 180 to inner capsule 152 using heat or by compressing outer capsule 180 against inner capsule 152 under pressure to fasten the parts together. An adhesive may also be used, if desired, to more securely attach outer capsule 180 to inner capsule 152.

Figure 26:
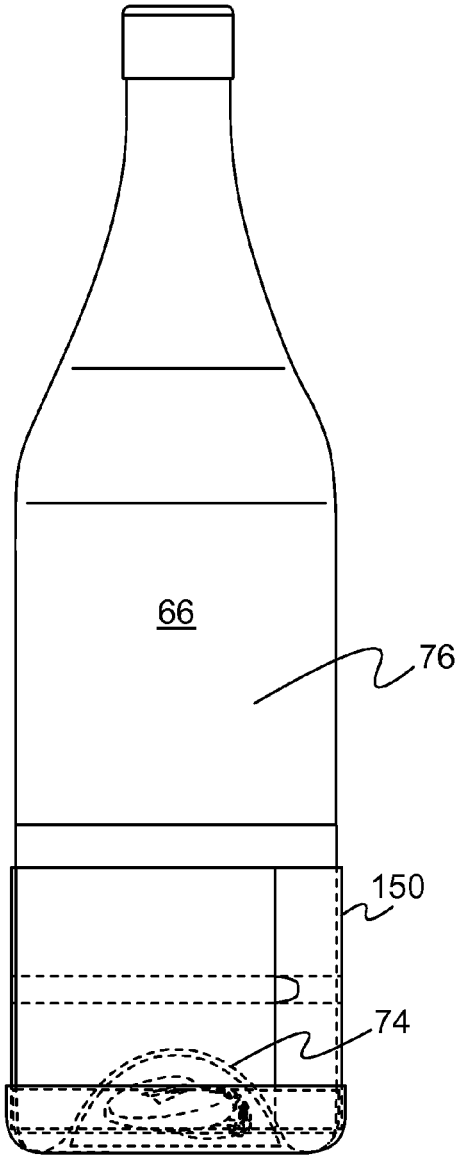
FIG. 26 illustrates a front elevational view of the punt capsule of FIG. 25 shown installed onto a bottle.

Installation of punt capsule 150 onto bottle 66 may occur by inserting punt capsule 150 over the bottom of bottle 66 and over bottle wall 76, as shown in FIG. 26, so as to nest the various surfaces of inner capsule 152 against the bottom surfaces of bottle 66, including the punt cavity of bottle 66. Punt capsule 150 may be secured to bottle 66 using the techniques described above, such as by shrinking punt capsule 150 to bottle 66 using heat or by compressing punt capsule 150 against bottle 66 under pressure to fasten the components together. An adhesive may also be used, if desired, to more securely attach punt capsule 150 to bottle 66.

To release and access item 204 from within chamber 200 when punt capsule 150 is fully installed on bottle 66, the user must first tear outer capsule 180 to sever and release the portion of outer capsule 180 below tear strip 185. To tear outer capsule 180, a user may grip loose end 193 of tear strip 185, which may extend exteriorly through, for example, either longitudinal seam 186 in skirt 182 or through an opening in skirt 182, and pull tear strip 185 to rupture skirt 182 along the periphery of skirt 182 until the portion of outer capsule 180 below tear strip 185 is severed and chamber 200 is released.

Once chamber 200 has been released from punt capsule 150 on bottle 66, the contents of chamber 200 may be accessed by, for example, gripping peel tab 208 of peel strip 206 (see FIG. 24, for example) and peeling peel strip 206 away off of chamber 200. Item 204 may then be retrieved from chamber 200. The technique for opening chamber 200 may depend on the type of closure actually employed on chamber 200.

Indicia similar to that shown and described for the previously described embodiments may be positioned on outer surfaces of inner capsule 152, such as in cavity 160 or on bottom 158, on or in chamber 200, on inside surfaces of outer capsule 180, such as on skirt 182 or on base 188, or separately included in cavity 160 or between inner capsule 152 and outer capsule 180. In this way, hidden messages may be provided to and read by, for example, consumers of bottle 66 after the portion of outer capsule 180 below tear strip 185 is severed and chamber 200 is released from punt capsule 150.

It should be understood that the teachings of the present invention would also apply to any punt cavity shape and to any cross sectional shape of bottle 66 or of chamber 200. It should also be understood that punt capsule 150 may comprise fewer parts to accomplish the same function as disclosed herein if punt capsule 150 is fabricated using alternative methods, such as by injection molding.

Another embodiment of the present invention is shown in FIGS. 27-37. In this embodiment, capsule 300 may include primary closure 310, item 46, cap 322 and skirt 301. Capsule 300 may, alternatively, only include primary closure 310 and cap 322 for housing item 46. Primary closure 310 may include chamber 312 for housing item 46.

As best shown in FIGS. 30-33, primary closure 310 may include head 311 and stub 318. Head 311 may include grip 314 positioned along a periphery of head 311 to assist a consumer in gripping primary closure 310 for installation or removal of primary closure 310 to and from bottle 66. Grip 314 may include a plurality of longitudinally oriented protrusions or a plurality of longitudinally oriented depressions, or both. Head 311 may also include bottom surface 315, which may be approximately flat and annular for abutting the rim of the bottle and for controlling the depth of insertion of stub 318 in a bottle.

Head 311 may further include chamber 312 for housing item 46. Chamber 312 may be formed completely within head 311, and may be disposed at or above top surface 68 of bottle 66. Alternatively, chamber 312 may extend partially into stub 318, and therefore extend below top surface 68, to form a larger cavity in primary closure 310. Chamber 312 and inner wall 313 may cooperate to form lip 317 of head 311. Lip 317 may comprise a relatively thin yet sturdy and resilient ring of material extending inwardly, the thickness of which is determined by the size and/or volume of chamber 312 relative to the size and/or volume of head 311.

Primary closure 310 may be made of any number and combination of materials and formed using any number or combination of techniques. For example, primary closure 310 may be made from cork, plastic, wood, metal, glass, or any combination of these. To form a reliable and reusable seal against bottle 66, primary closure 310 is preferably made from a resilient material. In one embodiment, primary closure 310 may comprise a synthetic material to reduce porosity of primary closure 310. Head 311 and stub 318 may be integrally formed to form primary closure 310 as a single piece, such as through a thermoplastic molding process, including a blow molding process, or a milling process using a single billet of material. Alternatively, head 311 and stub 318 may each be separately formed and brought together at a later stage in the manufacturing process. In this way, head 311 and stub 318 may each be made of different materials and/or use different manufacturing techniques to produce primary closure 310. If head 311 and stub 318 are separately formed, head 311 and stub 318 may be joined together using, for example, an adhesive or an insert molding process, to form primary closure 310. In one embodiment, chamber 312 is integrally formed with primary closure 310. In another embodiment, chamber 312 is formed by drilling and/or milling primary closure 310.

Primary closure 310 may also be made, at least in part, using one or more thermochromic materials that change color when exposed to specific temperatures. Primary closure 310 having thermochromic properties may be valuable to consumers of wine and other products as an indicator of product quality by indicating current or previous exposure to temperatures above or below a predetermined threshold or outside a given range. For example, primary closure 310 may be configured to include a thermochromic property where at least a portion of primary closure 310 turns black (or some other predetermined color) if primary closure 310 is ever exposed to a predetermined undesirable temperature during storage or transit after installation onto bottle 66.

Figure 28:
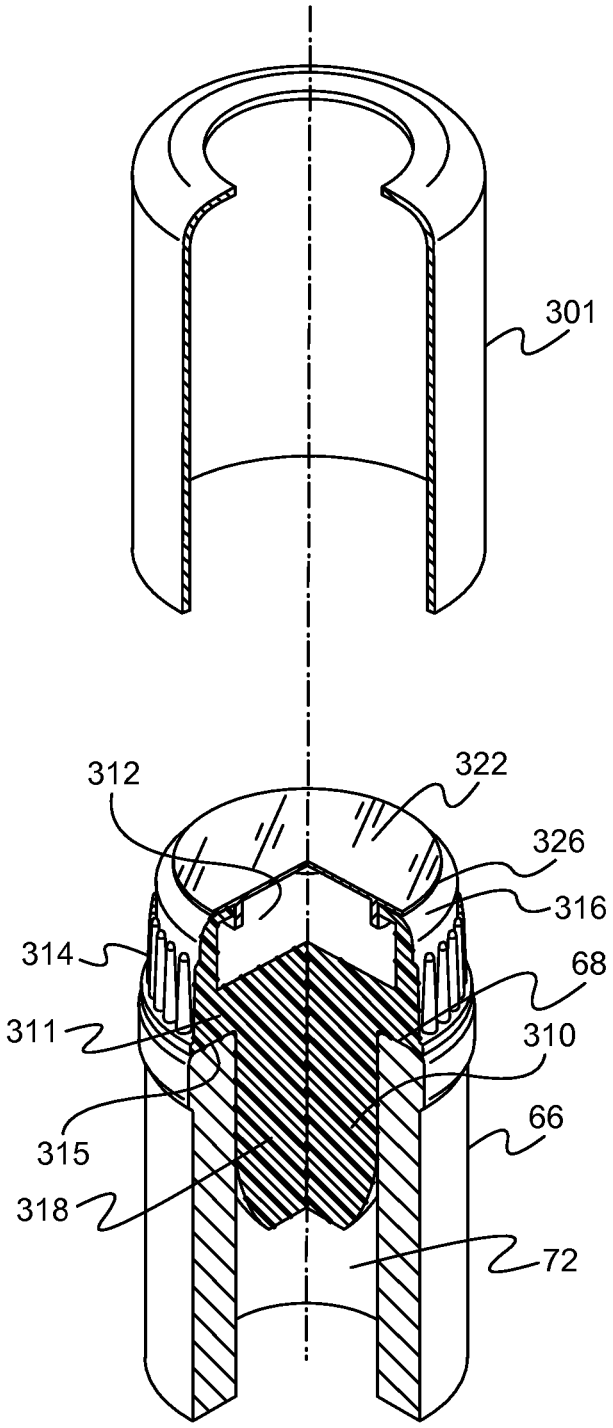
FIG. 28 illustrates a partial exploded view of the embodiment of FIG. 27.
Figure 29:
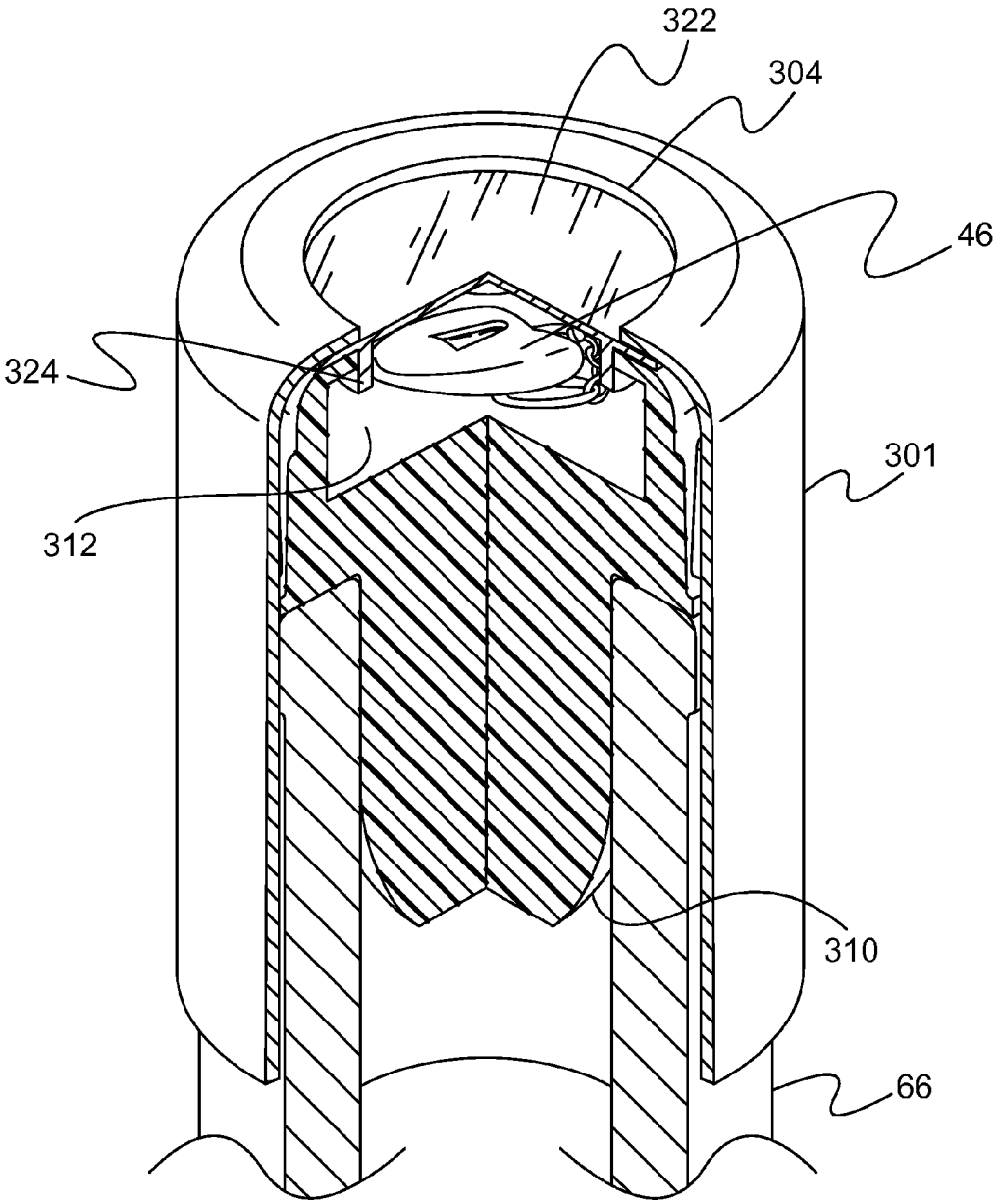
FIG. 29 illustrates a partial perspective view of the embodiment of FIG. 27.
Figure 30:
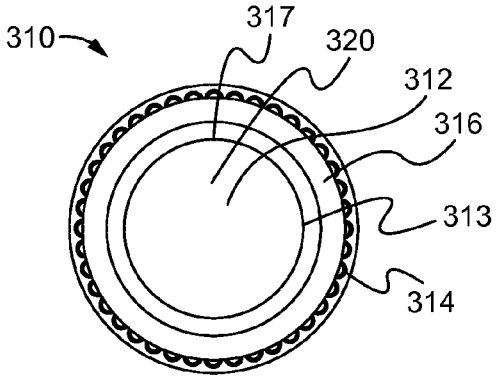
FIG. 30 illustrates a top plan view of the closure shown in the embodiment of FIG. 27.
Figure 31:
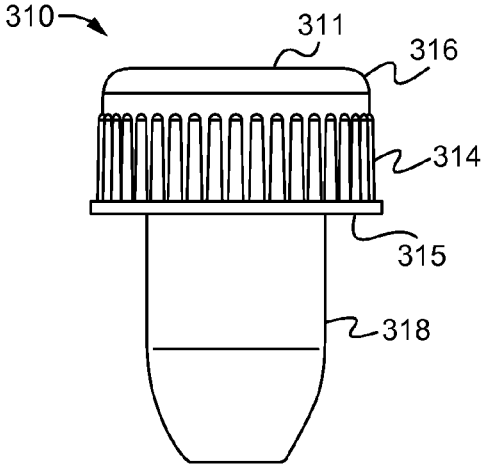
FIG. 31 illustrates a front elevational view of the closure shown in the embodiment of FIG. 27.
Figure 33:
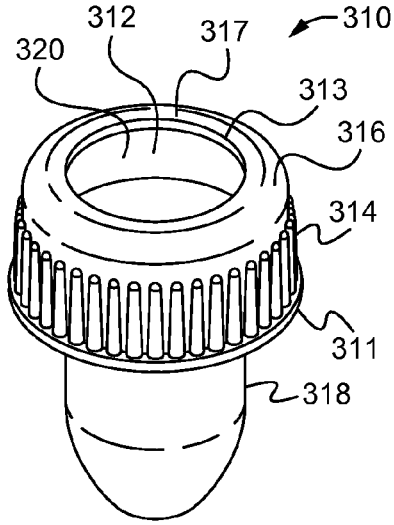
FIG. 33 illustrates a perspective view of the closure shown in the embodiment of FIG. 27.
Figure 32:
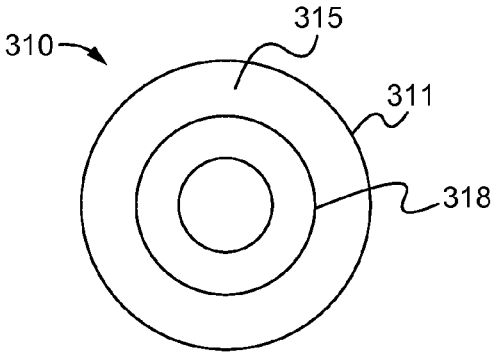
FIG. 32 illustrates a bottom plan view of the closure shown in the embodiment of FIG. 27.
Figure 34:
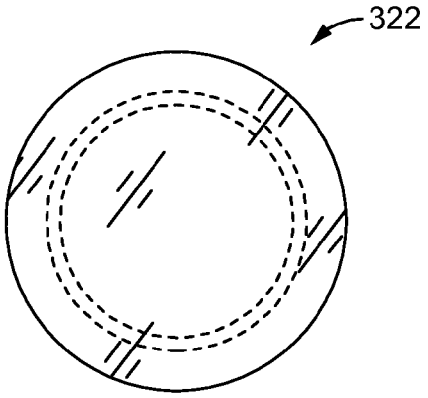
FIG. 34 illustrates a top plan view of the cap shown in the embodiment of FIG. 27.
Figure 35:
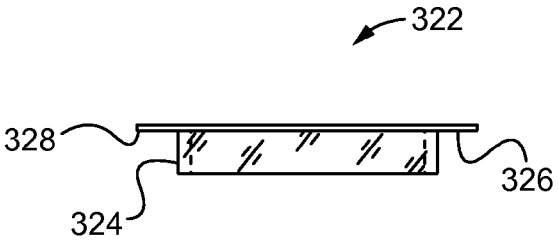
FIG. 35 illustrates a front elevational view of the cap shown in the embodiment of FIG. 27.
Figure 37:
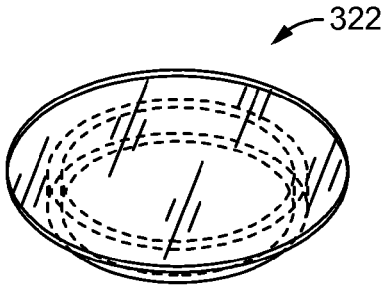
FIG. 37 illustrates a perspective view of the cap shown in the embodiment of FIG. 27.
Figure 36:
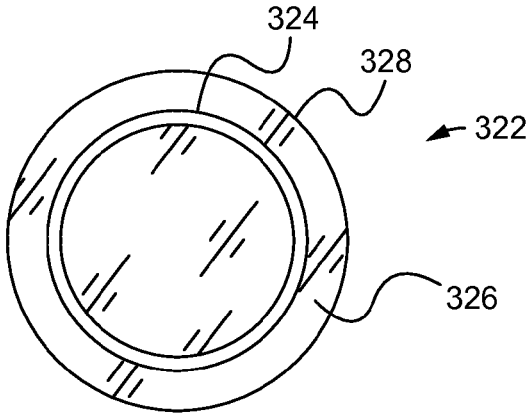
FIG. 36 illustrates a bottom plan view of the cap shown in the embodiment of FIG. 27.
Figure 38:
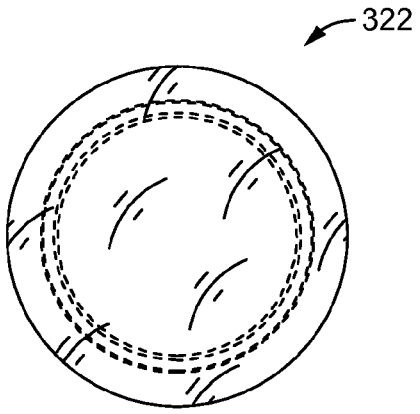
FIG. 38 illustrates a top plan view of another embodiment of the cap.
Figure 39:
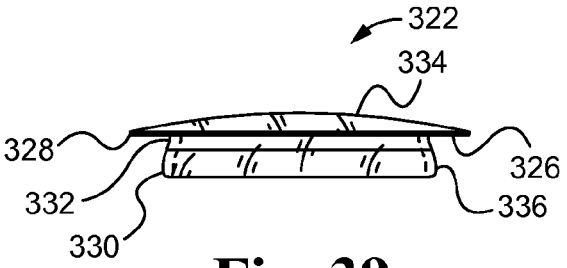
FIG. 39 illustrates a front elevational view of the cap shown in FIG. 38.
Figure 41:
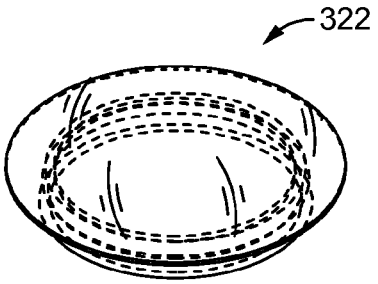
FIG. 41 illustrates a perspective view of the cap shown in FIG. 38.
Figure 40:
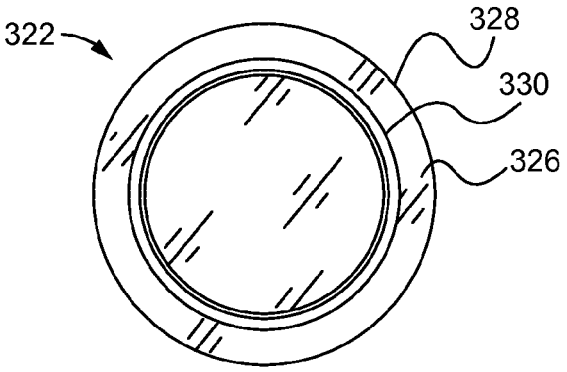
FIG. 40 illustrates a bottom plan view of the cap shown in FIG. 38.

As best shown in FIGS. 34-37, cap 322 may include protrusion 324 and lip 326. Protrusion 324 may extend from the bottom of cap 322 to at least the thickness of lip 317 of head 311. Lip 326 may extend peripherally and outwardly beyond protrusion 324 to approximately transition 316 when installed on head 311, as best shown in FIG. 28. Transition 316 may comprise a radius connecting the top of head 311 to a side wall of head 311. In this way, bottom edge 328 of cap 322 may become accessible to pry cap 322 from head 311 using, for example, a pry tool or a fingernail. To provide accessibility of lip 326 without extending lip 326 to approximately transition 316, lip 326 may alternatively comprise a chamfer along at least a portion of bottom edge 328. In one embodiment, cap 322 includes convex top surface 334 to form a lens through which item 46 may appear magnified.

The underside of cap 322 inside protrusion 324 may be hollow, as shown in FIGS. 34-37. Alternatively, protrusion 324 may be solid. Protrusion 324 may be configured to be generally circular, as shown in FIGS. 34-37, or may be any closed geometric shape so as to fit within a complementary opening formed by chamber 312. In one embodiment, protrusion 324 of cap 322 may be configured to fit within a groove formed in primary closure 310. In another embodiment, cap 322 may be hingedly attached to primary closure 310. In yet another embodiment, as shown in FIGS. 38-41, protrusion 330 of cap 322 may be bell-shaped to engage opening 320 of chamber 312. For example, neck 332 of bell-shaped protrusion 330 may be smaller than base 336 of protrusion 330 and be configured to cooperate with inner wall 313 and lip 317 of head 311. In this way, neck 332 may nest with inner wall 313 and lip 317 once cap 322 is installed on head 311 to removably secure cap 322 to head 311.

Cap 322 may be made from any number of materials and formed using any number of techniques. For example, cap 322 may be made from cork, plastic, wood, metal, or glass. Cap 322 may be as a single piece, such as through a thermoplastic molding process, including a blow molding process, or by a milling process using a single billet of material. In one embodiment, cap 322 is configured to be transparent to permit visual access to item 46 in chamber 312. In another embodiment, cap 322 is configured to be semi-transparent to partially hide item 46 from view. In yet another embodiment, cap 322 is configured to be opaque to completely hide item 46 from view.

Figure 27:
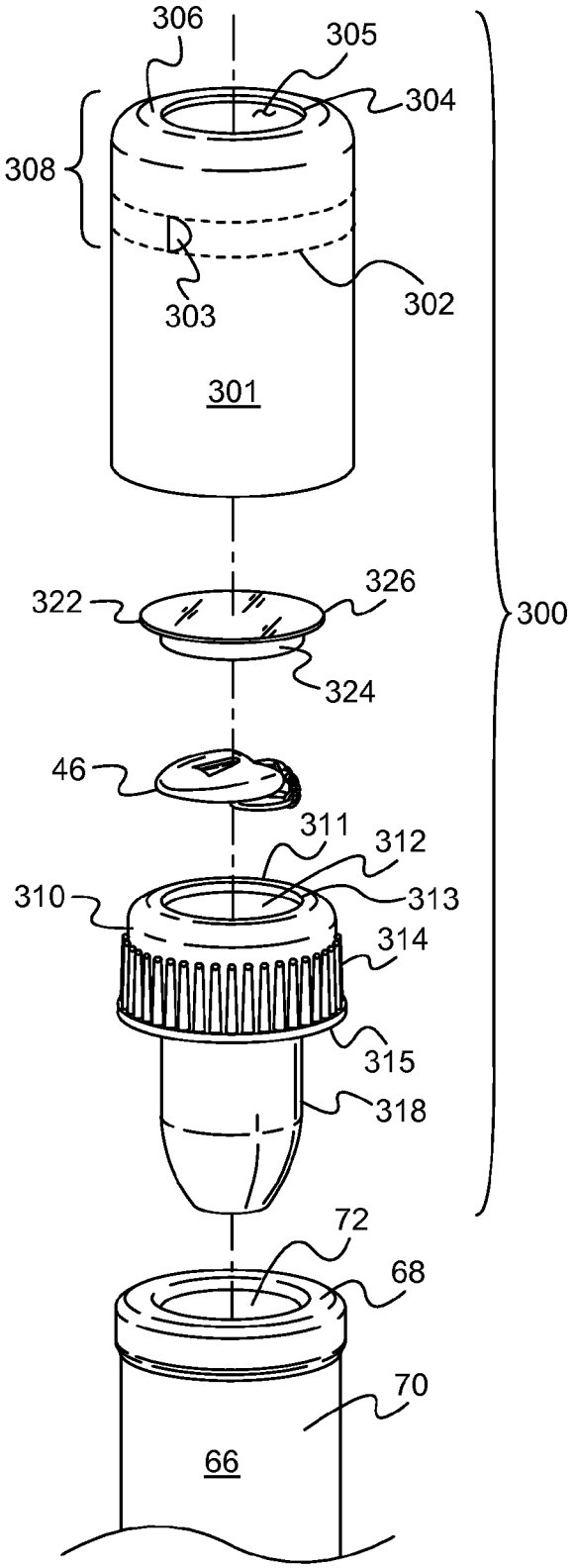
FIG. 27 illustrates an exploded perspective view of another embodiment of the invention.

As shown in FIG. 27, primary closure 310 may be inserted into mouth 72 of bottle 66 using conventional means. Once installed, bottom surface 315 of primary closure 310 may abut bottle top 68 to form a seal against bottle 66 in addition to forming a seal between stub 318 of primary closure 310 and the inside wall of bottle 66. Item 46 may be inserted into chamber 312 either before or after installation of primary closure 310 into mouth 72. If chamber 312 is inserted before primary closure 310 is inserted into mouth 72, then a temporary closure may be employed to retain item 46 in chamber 312. Stub 318 of primary closure 310 may be capable of multiple insertions into and extractions from a bottle by simply gripping primary closure 310, rotating primary closure 310 to exceed the static friction between stub 318 and the wall of bottle 66, and either inserting or extracting stub 318 into or from bottle 66.

To secure item 46 inside chamber 312, cap 322 may be inserted onto head 311 and over opening 320 of chamber 312. While inserting cap 322 onto head 311, protrusion 324 of cap 322 may cause inner wall 313 and lip 317 to resiliently deform. When inserted, protrusion 324 of cap 322 may form an interference fit with inner wall 313. In another embodiment, when inserting cap 322, protrusion 330 of cap 322 may initially resiliently deform inner wall 313 and lip 317, but when fully inserted, neck 332 of protrusion 330 may form a slight clearance or a slight interference fit with inner wall 313 and lip 317. An adhesive may also be used, if desired, anywhere cap 322 adjoins primary closure 310 to seal item 46 from atmospheric dirt and contamination.

To further secure cap 322 to chamber 312, skirt 301 may be installed over cap 322 and primary closure 310 to cause wall 306 to at least partially cover cap 322. Skirt 301 may include aperture 304, which may be smaller in size than cap 322. Skirt 301 may be secured to and substantially conform to at least a portion of primary closure 310 and to bottle 66, over the entirety of bottle 66 or over any portion of bottle 66, such as neck 70. Skirt 301 may be shrink-fit by shrinking skirt 301 using heat or by compressing skirt 301 under pressure to conform to bottle 66, to primary closure 310 and/or cap 322, or to all three components. An adhesive may also be used, if desired, to more securely attach skirt 301 to these components. Skirt 301 may be transparent, semi-transparent, or opaque.

To permit the optional visual access to item 46 while housed in chamber 312, aperture 304 of skirt 301 may reveal chamber 312 and its contents through optional cap 322. Skirt 301 of capsule 300 may also include a transparent, semi-transparent, or opaque disk or other cover that spans aperture 304 to display, obscure, or prevent display of item 46 and to secure item 46 in chamber 312 if cap 322 is not present. Skirt 301 of capsule 300 may optionally not include aperture 304 and instead may completely cover chamber 312. However, a completely covered chamber 312 may still be visible depending on the chosen transparency of skirt 301.

To gain access to cap 322 and item 46, skirt 301 of capsule 300 may include tear strip 302 affixed or secured to inner surface 305 of skirt 301. Tear strip 302, and loose end 303 usable for gripping and actuating tear strip 302, may provide a convenient method for partially or completely separating top portion 308 of skirt 301 from skirt 301 to access cap 322 and to permit access to both the contents of chamber 312 (i.e., item 46) as well as to primary closure 310 of bottle 66. Alternatively, if tear strip 302 is not included with capsule 300, top portion 308 may be separated from capsule 300 using any conventional tool for such purpose. However, using such additional tool may be more expensive to acquire and cumbersome to deploy as compared to using the features disclosed in the present invention. Alternatively, skirt 301 may instead be configured to be removed by hand by, for example, simply pulling or peeling skirt 301 off of bottle 66.

Tear strip 302 shown in FIG. 27 may be oriented substantially circumferentially on inner surface 305 to permit removal of at least top portion 308 of capsule 300, or possibly the entirety of capsule 300, if desired, from bottle 66. Tear strip 302 may optionally be positioned near bottle top 68 to provide a torn edge of skirt 301 approximately at or below bottle top 68. Alternatively, tear strip 302 may be oriented in any one of a number of different orientations, such as in a helical pattern, a zig-zag pattern, or a substantially longitudinal (vertical) orientation to permit removal of at least top portion 308, and perhaps the entirety, of capsule 300 from bottle 66. Tear strip 302 may be a separate piece that is affixed to inner surface 305 of skirt 301 or tear strip 302 may be integrally formed with skirt 301. If tear strip 302 is a separate piece, tear strip 302 may be made from a different material than skirt 301.

Similar to what is shown in FIG. 14, capsule 300 of FIG. 27 may also include indicia, such as indicia 107, positioned on an inner surface of capsule 300, such as on inner surface 305 of skirt 301, underneath a disk (not shown) or other cover that may cover aperture 304, or separately included under cap 322. In this way, hidden messages may be provided to and read by, for example, consumers of bottle 66 after removing top portion 308 from skirt 301.

To gain access to item 46 housed in chamber 312, cap 322 may be removed from primary closure 310 using an object, such as a fingernail or even a screw driver inserted under lip 326 of cap 322, to pry cap 322 off of primary closure 310 using lever action.

While specific embodiments of the invention have been described in detail, it will be appreciated by those skilled in the art that various modifications and alternatives to those details could be developed in light of the overall teachings of the disclosure. Accordingly, the particular invention disclosed is meant to be illustrative only and not limiting as to the scope of the invention which is to be given the full breadth of the appended claims and any equivalents thereof.

What is claimed is:

1. A closure for a bottle, the bottle having a rim and an inside surface defining a mouth, the closure comprising:

a stopper comprising:

a head portion comprising:

a chamber for housing an item;

an open top providing access to the chamber;

a cylindrical sidewall;

an annular upper lip surrounding the open top and extending inwardly from a top of the cylindrical sidewall; and an annular base extending inwardly from a bottom of the cylindrical sidewall, the annular base configured to abut the rim of the bottle; and an imperforate stub body protruding downwardly from the annular base of the head portion, the stub body comprising:

a circumferential sidewall;

a closed base;

wherein the stub body extends across the mouth and engages the inside surface of the bottle to seal the bottle and provide a releasable interference fit; and a removable cap closing the open top of the head portion, the cap comprising:

an annular sidewall; and a closed top wall comprising:

an upper disc surface; and an annular lower surface surrounding the annular sidewall;

wherein the annular sidewall and the annular lower surface engage the annular upper lip of the head portion to enclose the item within the chamber.

2. The closure of claim 1, wherein the cylindrical sidewall further comprises a grip having at least one of a plurality of longitudinally oriented protrusions and a plurality of longitudinally oriented depressions.

3. The closure of claim 1, wherein annular base of the head portion controls an insertion depth of the stub body in the bottle.

4. The closure of claim 1, wherein the head portion is integrally formed with the stub body to form the stopper.

5. The closure of claim 1, wherein the cap is transparent to provide visual access to the item in the chamber.

6. The closure of claim 1, wherein a peripheral portion of the closed top wall and the annular lower surface of the cap define a lip extending axially outward from the annular sidewall to approximately a transition between the annular upper lip and the annular sidewall of the head portion, wherein a bottom edge of the lip is accessible to pry the cap from the head portion.

7. The closure of claim 1, wherein the upper disc surface is a convex top surface to form a lens.

8. The closure of claim 1, wherein at least one of the head portion and the stub body comprise a thermochromic property.

9. The closure of claim 1, wherein the annular sidewall extending from the closed top wall of the cap comprises a bell-shaped profile having a base larger than a neck.

10. The closure of claim 9, wherein the neck of the annular sidewall engages the open top and releasably secures the cap to the head portion.

11. The closure of claim 10, wherein annular upper lip engages the neck of the annular sidewall.

12. The closure of claim 11, wherein the annular upper lip comprises a clearance with the neck and an interference with the base of the annular sidewall of the cap.

13. The closure of claim 11, wherein the annular upper lip is resilient and cooperates with the base and the neck of the annular sidewall of the cap.

* * * * *